US011801191B2

(12) United States Patent
Baldwin et al.

(10) Patent No.: US 11,801,191 B2
(45) Date of Patent: Oct. 31, 2023

(54) HYPOTROCHOID ASSEMBLY FOR GENERATING VIBRATIONS IN AN EXERCISE MACHINE AND METHOD FOR USING SAME

(71) Applicant: Performance Health Systems, LLC, Northbrook, IL (US)

(72) Inventors: Alan Dart Baldwin, San Jose, CA (US); Barry Everett Wood, Milpitas, CA (US)

(73) Assignee: Performance Health Systems, LLC, Northbrook, IL (US)

( * ) Notice: Subject to any disclaimer, the term of this patent is extended or adjusted under 35 U.S.C. 154(b) by 391 days.

(21) Appl. No.: 17/116,761

(22) Filed: Dec. 9, 2020

(65) Prior Publication Data

US 2021/0169725 A1 Jun. 10, 2021

Related U.S. Application Data

(60) Provisional application No. 62/946,304, filed on Dec. 10, 2019.

(51) Int. Cl.

| | |
|---|---|
| ***A61H 1/00*** | (2006.01) |
| ***A61H 23/00*** | (2006.01) |
| ***A63B 22/06*** | (2006.01) |

(52) U.S. Cl.

CPC ..... *A61H 1/005* (2013.01); *A61H 23/004* (2013.01); *A61H 2201/1261* (2013.01); *A61H 2201/1472* (2013.01); *A63B 22/06* (2013.01)

(58) Field of Classification Search

CPC .. A61H 1/005; A61H 23/004; A61H 23/0263; A61H 2201/1261; A61H 2201/1215; A61H 2201/1472; A61H 2207/00; A63B 22/06; A63B 22/0605; A63B 2022/0611; B06B 1/161; F16H 21/00; F16H 21/36; F16H 21/365; F16H 37/12; F16H 37/122; F16H 37/124;

(Continued)

(56) References Cited

U.S. PATENT DOCUMENTS 5,364,271 A 11/1994 Aknin et al.
2009/0236901 A1* 9/2009 Kim ..... B60B 27/047 301/1

(Continued)

FOREIGN PATENT DOCUMENTS

WO 2010005286 A1 1/2010

OTHER PUBLICATIONS

KHV Planetary Gearing Part I, Dr. David Yu, MPC Products Corp. Gear Technology Nov./Dec. 1987 issue (Nov. 1987).

(Continued)

*Primary Examiner* — Philip R Wiest
*Assistant Examiner* — Nathan M Le
(74) *Attorney, Agent, or Firm* — Perry Hoffman

(57) ABSTRACT

An inner assembly and an outer assembly of a hypotrochoid apparatus with a spindle located inside the inner assembly where a spindle proximate end and a spindle distal end each employ at least one mechanical interface. An eccentric hub provides a central throughbore for receiving a spindle, where the spindle is rotatably engaged with the eccentric hub and the inner bore which enhances vibration when the spindle is rotating and the eccentric hub is engaged.

20 Claims, 22 Drawing Sheets

(58) Field of Classification Search
CPC ..... F16H 2037/128; B62M 3/06; B62M 3/08; Y01T 74/18232; Y01T 74/18056
USPC ..... 74/640
See application file for complete search history.

(56) References Cited

U.S. PATENT DOCUMENTS

| | | | | |
|---|---|---|---|---|
| 2011/0152040 | A1* | 6/2011 | Van Der Meer | A63B 21/00076 482/57 |
| 2015/0045190 | A1* | 2/2015 | Keiser | A63B 21/00196 474/112 |
| 2015/0080190 | A1* | 3/2015 | Kaan | A63B 21/00196 482/57 |
| 2016/0056685 | A1* | 2/2016 | Fujimoto | B06B 1/166 310/81 |
| 2017/0350314 | A1* | 12/2017 | Lee | F01B 5/00 |
| 2018/0009608 | A1* | 1/2018 | Danner | E05F 15/603 |
| 2018/0043396 | A1* | 2/2018 | Bellec | B65G 27/28 |
| 2018/0306285 | A1* | 10/2018 | Noguchi | F16H 48/14 |
| 2019/0183725 | A1* | 6/2019 | Chang | A63B 21/225 |
| 2019/0201741 | A1* | 7/2019 | Chang | B06B 1/167 |

OTHER PUBLICATIONS

KHV Planetary Gearing Part II, Dr. David Yu, MPC Products Corp.
Gear Technology Jan./Feb. 1988 issue (Jan. 1988).
Elements of Metric Gear Technology, SDP/SI May 2011.
Ship Vibration Report 1451 by R.T. McGoldrick, Dec. 1960.
Some Mechanisms Using Internal Gears with Small Difference in Numbers of Teeth, New Advances in Mechanism and Machine Science (pp. 357-366), O. Crivoi and I. Doroftei, Jan. 2018.

* cited by examiner

HYPOTROCHOID ASSEMBLY FOR GENERATING VIBRATIONS IN AN EXERCISE MACHINE AND METHOD FOR USING SAME

FIELD OF THE INVENTION

The present disclosure relates to hypotrochoid assemblies. More specifically, the present disclosure relates to hypotrochoid assemblies and methods for creating vibrations in an exercise machine.

BACKGROUND OF THE INVENTION

Health problems related to or induced by obesity, or being overweight, are a matter of serious national concern. The epidemic of obesity results in tens of billions of dollars of additional healthcare expense every year, and research suggests that it will remain on the rise.

Many experts believe that the primary mechanism involved in maintaining a healthy bodyweight, or treating obesity, is regular physical exercise. It is clear that numerous avenues for physical exercise already exist. However, they are underutilized and have not resolved the problem of obesity. This lack of utilization likely stems from a combination of factors, such as lack of clarity and connection for the average person with regard to what exercise must be performed, and how much time the person needs to invest in exercising to achieve the desired goal. A defined protocol that results in a known outcome does not exist. Every person's results are different, even when a group of people perform the same exercise together for the same length of time. Studies have shown that the predominant reason given by people for not exercising is lack of time to invest in exercising.

One way to reduce the time necessary to achieve a fitness goal is to work multiple sections of the body at one time. A vibration assembly or multiple assemblies can be attached to an exercise machine, such as bicycles and elliptical machines, to create vibrations that engage the core muscles of a user while the user is engaged in a cardio work out. These vibration assemblies, however, cause the exercise equipment to vibrate and/or rattle, which loosens the hardware holding the equipment together, causing the equipment to disassemble and fall apart.

There remains a need for a vibration assembly that engages the core muscles of a user of exercise equipment without causing the equipment to disassemble and fall apart.

SUMMARY OF THE INVENTIONS

The present disclosure relates to a hypotrochoid assembly for generating vibrations in an exercise apparatus and method for using same which does not cause the exercise apparatus to disassemble and fall apart.

In one aspect of this disclosure that may be combined with any other aspect of this disclosure, a hypotrochoid apparatus for creating vibrations in an exercise machine can comprise an inner assembly and an outer assembly. The inner assembly can comprise a spindle, eccentric hub, bearings, keys, retaining rings, and external involute gear. The spindle can be located inside the eccentric hub. The spindle has a proximate end and a spindle distal end, wherein said spindle proximate end and said spindle distal end each comprise at least one mechanical interface and are not located inside the eccentric hub. A groove can be milled around an outer circumference of the spindle for engaging an inner retainer ring, and a key, such as a woodruff key though this disclosure is not intended to be limited to woodruff type keys, positioned parallel to the longitudinal length of the spindle to secure the external involute gear. A first sealed bearing can be mounted on the spindle proximate end. Both sealed bearings allow the spindle to rotate within the eccentric hub and support the load generated by the user. Both sealed bearings are in abutment with an inner surface of the eccentric hub. A first angular contact ball bearing comprises a distal side and a proximate side and centrally mounted around the outer surface of the eccentric hub, and a second angular contact ball bearing comprises a distal side and a proximate side being centrally mounted around the outer surface of the eccentric hub, wherein the proximate side of the first angular contact ball bearing abuts the distal side of the second angular contact ball bearing. In one aspect of this disclosure that may be combined with any other aspect of this disclosure, the outer assembly can comprise an outer hollow housing being cylindrically shaped and having a proximate end and a distal end, a first retaining ring being positioned inside the outer hollow housing at the proximate end of the outer hollow housing.

In one aspect of this disclosure that may be combined with any other aspect of this disclosure the outer assembly can comprise a clutch assembly comprising a central throughbore for receiving the inner assembly, wherein the clutch assembly is positioned at the distal end of the outer hollow housing.

In one aspect of this disclosure that may be combined with any other aspect of this disclosure, the hypotrochoid apparatus can comprise a ring shaped shim comprising a central opening, an inner surface, and an outer surface for closing a gap between the first retaining ring and the proximate end of the outer hollow housing after the inner assembly is concentrically coupled within the outer hollow housing, wherein the inner surface of the shim is abutted against the first retaining ring.

In one aspect of this disclosure that may be combined with any other aspect of this disclosure, the hypotrochoid apparatus can comprise a second retaining ring positioned inside the proximate end of the outer hollow housing and abutted against the outer surface of the shim.

One aspect of this disclosure may be combined with any other aspect of this disclosure, the inner assembly can be concentrically coupled within the outer assembly, and the at least one mechanical interface is coupled to a crank arm.

Figure 1:
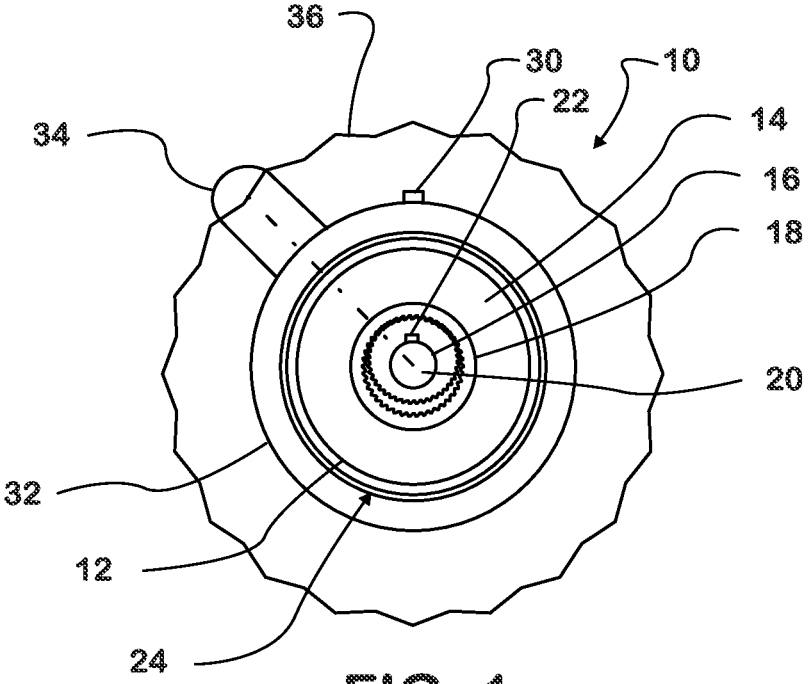
FIG. 1 illustrates a side plan view of an embodiment of the hypotrochoid assembly in accordance with the principles of the present disclosure.

Any measurements or quantifying data contained in the FIGURES is not intended to limit the scope of this disclosure. Any measurements and/or quantifying data contained in the illustrations is for exemplary purposes only and is not intended to be interpreted as providing concrete measurements/quantifying data necessary to understand the scope of this disclosure.

DETAILED DESCRIPTION OF THE EMBODIMENTS

The following detailed embodiments presented herein are for illustrative purposes. That is, these detailed embodiments are intended to be exemplary of the present disclosure for the purposes of providing and aiding a person skilled in the pertinent art to readily understand how to make and use the technology of the present disclosure.

Throughout this specification, unless the context requires otherwise, the word "comprise" or variations such as "comprises" or "comprising" or the term "includes" or variations, thereof, or the term "having" or variations thereof will be understood to imply the inclusion of a stated element or integer or group of elements or integers but not the exclusion of any other element or integer or group of elements or integers. In this regard, in construing subsequent claims, embodiment where one or more features is added to any of the claims is to be regarded as within the scope of the invention given that the essential features of the invention as claimed are included in such an embodiment.

Accordingly, the detailed discussion herein of one or more embodiments is not intended, nor is to be construed, to limit the metes and bounds of the patent protection afforded the present disclosure in which the scope of patent protection is intended to be defined by any claims and equivalents thereof. Therefore, embodiments not specifically addressed herein, such as adaptations, variations, modifications, and equivalent arrangements, should be and are considered to be implicitly disclosed by the illustrative embodiments any claims described herein and therefore fall within the scope of the present disclosure.

Additionally, it is important to note that each term used herein refers to that which a person skilled in the relevant art would understand such term to mean based on the contextual use of such term herein. To the extent that the meaning of a term used herein, as understood by the person skilled in the relevant art based on the contextual use of such term, differs in any way from any particular dictionary definition of such term, it is intended that the meaning of the term as understood by the person skilled in the relevant art should prevail.

Further, it should be understood that, any steps of subsequent claimed methods may be shown and described as being in a sequence or temporal order, the steps of any such method are not limited to being carried out in any particular sequence or order, absent an indication otherwise. That is, the claimed method steps are considered capable of being carried out in any sequential combination or permutation order while still falling within the scope of the present disclosure.

Figure 81:
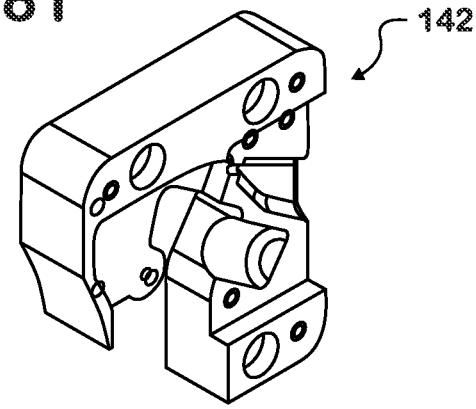
FIG. 81 is a top perspective view of an embodiment of a clutch cable mount in accordance with the principles of the present disclosure.
Figure 84:
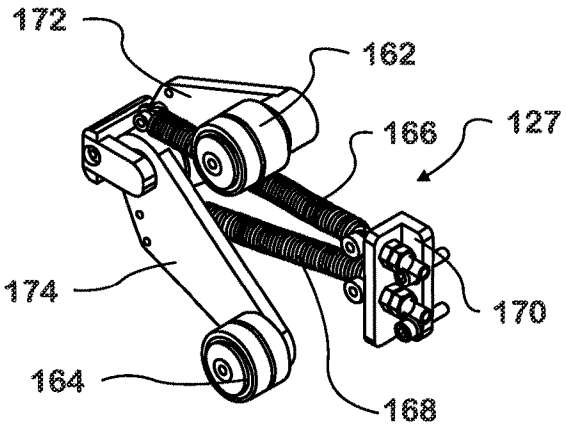
FIG. 84 is a top perspective view of an embodiment of the belt tensioner system in accordance with the principles of the present disclosure.
Figure 83:
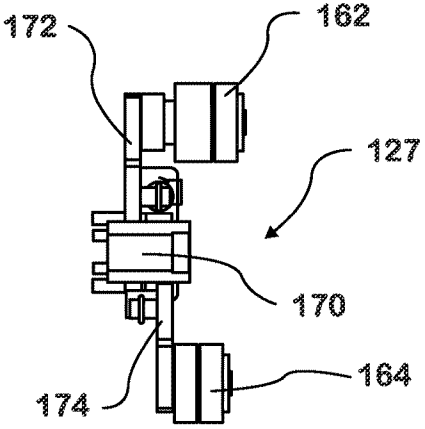
FIG. 83 is a front plan view of an embodiment of the belt tensioner system in accordance with the principles of the present disclosure.
Figure 86:
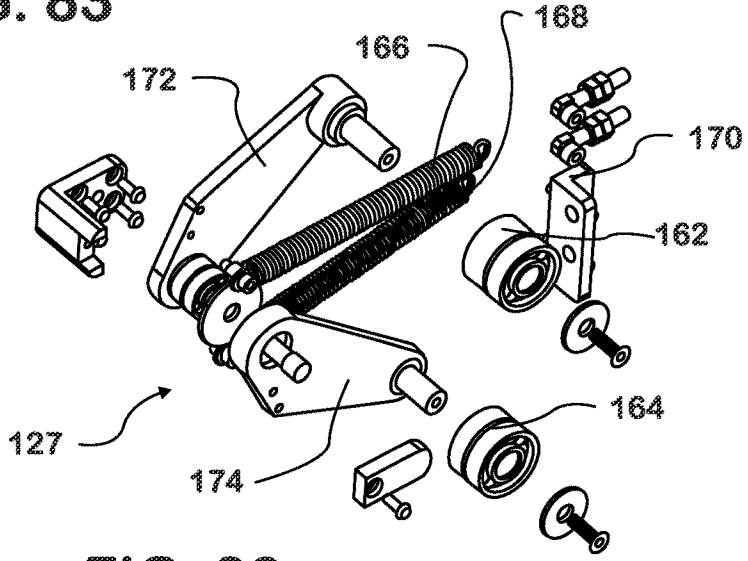
FIG. 86 is an exploded view of an embodiment of the belt tensioner system in accordance with the principles of the present disclosure.
Figure 82:
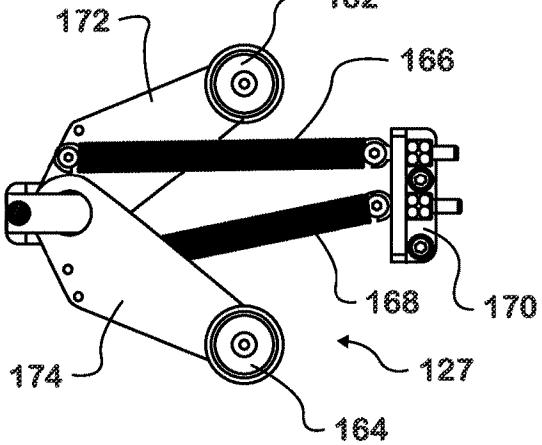
FIG. 82 is a side plan view of an embodiment of a belt tensioner system in accordance with the principles of the present disclosure.
Figure 85:
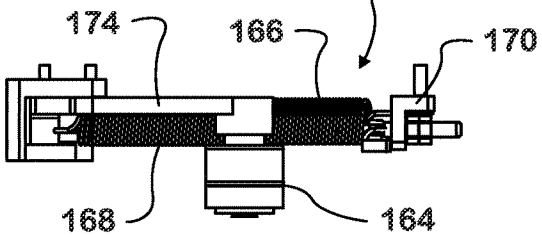
FIG. 85 is a bottom plan view of an embodiment of the belt tensioner system in accordance with the principles of the present disclosure.

As shown in FIGS. 1-81, a hypotrochoid apparatus 10 generates vibrations when supplied mechanical power. A drive-shaft or spindle contained within a rotating eccentric hub can be used. Rotation of the eccentric hub can be driven by the drive-shaft or spindle via single-planet epicyclic gearing. A rotor clutch assembly 92 can be included to control the single ring gear 18 and to engage and disengage vibration.

Turning to FIG. 1, at least one embodiment of the hypotrochoid apparatus 10 is illustrated for exemplary purposes. The hypotrochoid apparatus 10 comprises an inner assembly 12. The inner assembly 12 comprises a housing 14 (see other Figures), single planetary gear 16, single ring gear 18, spindle 20, key 22 positioned parallel to the longitudinal length of the spindle 20, and a clutch plate 24 affixed to the outside of the inner assembly and sealing the housing 14. Placing the single planetary gear 16 inside the single ring gear 18 creates an external involute gear 19. The key 22 can be a woodruff type key. The housing 14 comprises a hollow interior. The hypotrochoid apparatus 10 also comprises an outer assembly 26 comprising an eccentric hub 28, clutch pin 30, and outer housing 32. A crank arm 34 can be engaged to the spindle 20 and control the rotation of the hypotrochoid apparatus 10. An example of at least one possible path of travel 36 of the crank arm 34 can be seen in FIG. 1.

Figure 2:
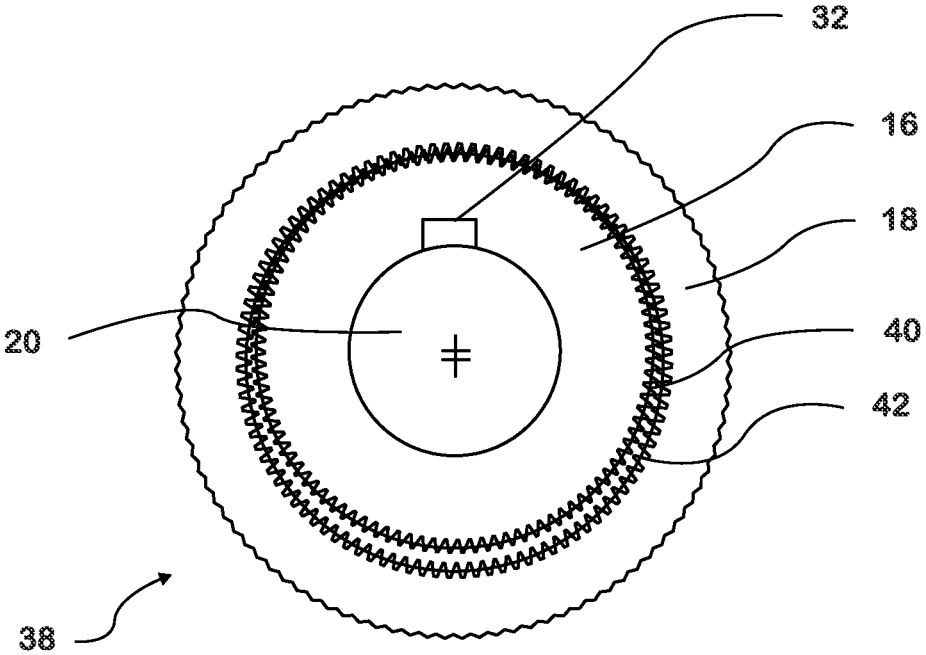
FIG. 2 illustrates a side plan view of a planet gear of an embodiment of the hypotrochoid assembly in accordance with the principles of the present disclosure.

Turning to FIG. 2, an example of a planetary gear assembly 38 illustrated. The single planetary gear 16 comprises a central throughbore (see FIGS. 6 and 8) to accept the spindle 20. The single planetary gear 16 comprises teeth and spaces between the teeth along the outer surface 40 of the single planetary gear 16 and is nested inside a central throughbore (See FIGS. 9 and 11) of the single ring gear 18. The single ring gear 18 comprises teeth and spaces between the teeth on the inner rim 42 of the single ring gear 18. The teeth of the single planetary gear 16 engage the teeth spaces on the inner rim 42 and the teeth spaces on the outer surface 40 engage the teeth on the inner rim 42. The single planetary gear 16 is smaller than the size of the central throughbore of the single ring gear, causing a gap 44 on the opposite side of when at least some teeth of the inner rim 42 are engaged to at least some of the upper teeth spaces. The teeth and teeth spaces can be varied in dimension and distance to produce a desired vibration pattern.

The hypotrochoid apparatus can be comprised of multiple machine elements which function to support, drive, and control an eccentric hub 28. Fundamentally, the eccentric hub 28 produces mechanical perturbations in a spindle 20 at a frequency directly proportional to its own angular velocity about a fixed axis. The amplitude of this perturbation is inherent to the eccentric hub's 28 designed eccentricity.

Figure 3A:
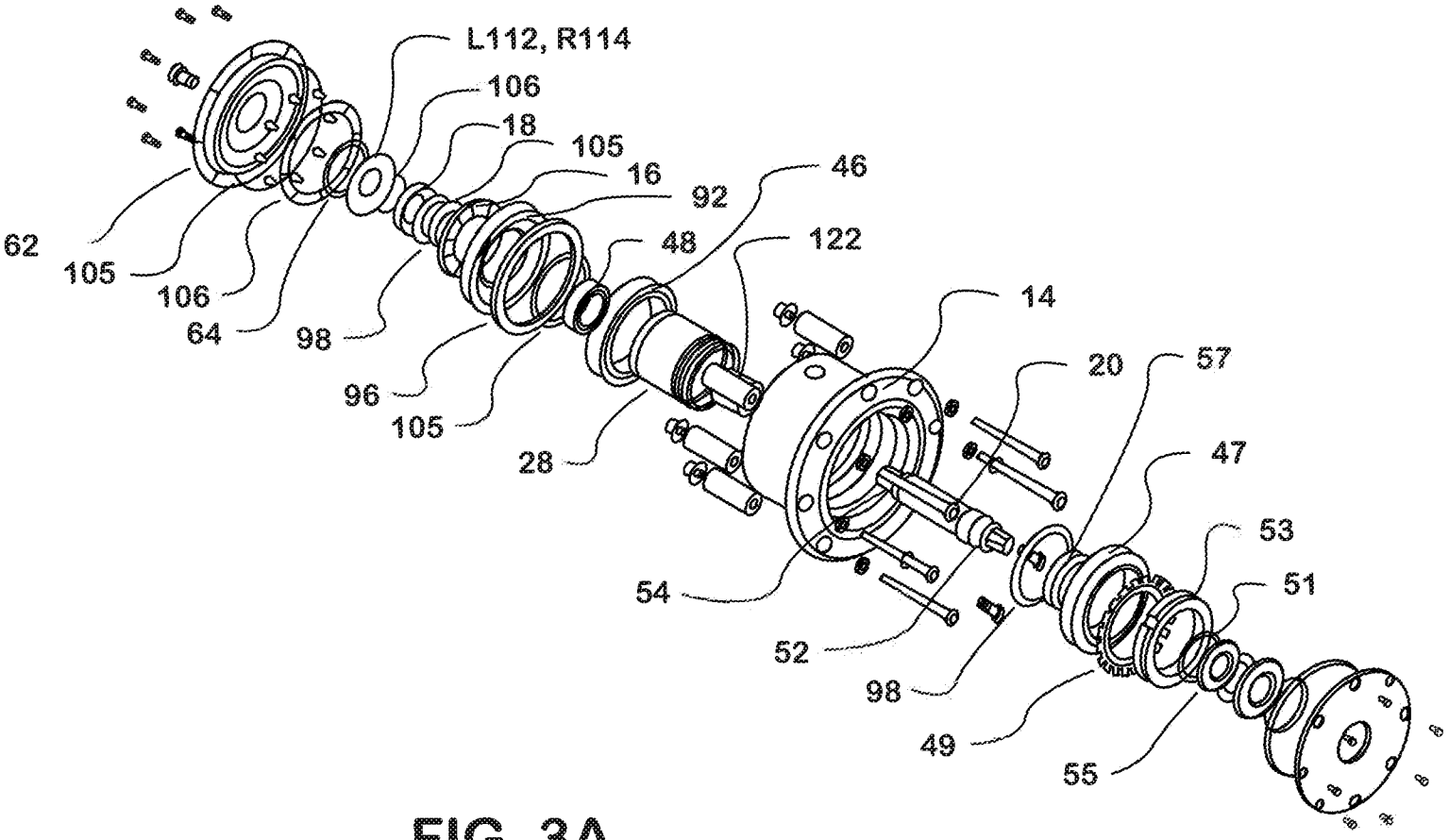
FIG. 3A illustrates an exploded perspective view of an embodiment of the hypotrochoid assembly in accordance with the principles of the present disclosure.
Figure 3B:
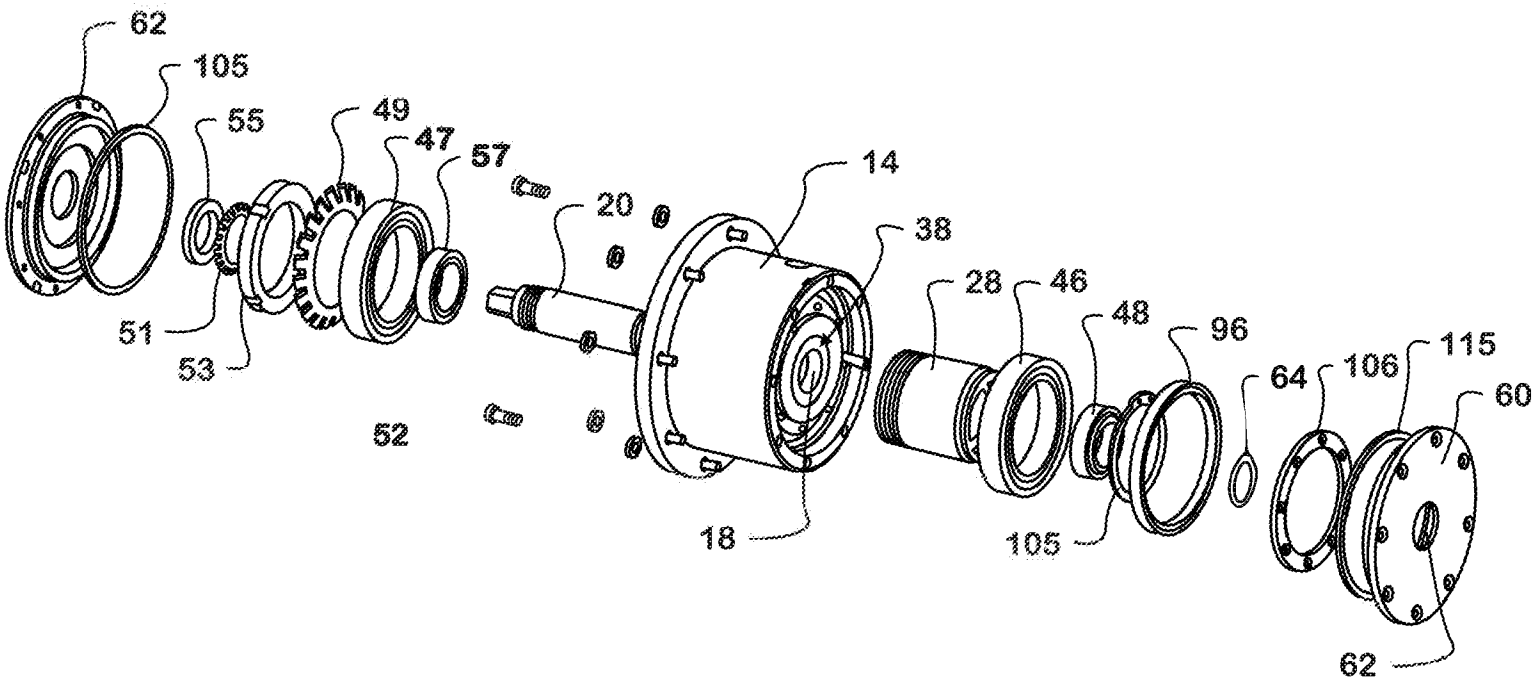
FIG. 3B illustrates an exploded perspective view of an embodiment of the hypotrochoid assembly with the inner assembly fully assembled in accordance with the principles of the present disclosure.

Turning to FIGS. 3A and 3B, an exploded view of an exemplary embodiment of the hypotrochoid apparatus 10 is illustrated. An outer bearing or first angular contact ball bearing 46, 47 supports the eccentric hub 28 and a second angular contact ball bearing 48, 57 allows the driveshaft to spin freely within the eccentric hub 28 about a moving axis. FIG. 3B provides an exemplary embodiment of the inner assembly 12 fully assembled. The inner assembly 12 may also be known as a bottom bracket in the industry. In FIG. 3A, the inner assembly 12 as well as the hydrotrochoid apparatus 10 is shown disassembled. FIG. 3B is oriented as a mirror image of FIG. 3A, to illustrate the other side of the elements illustrated in FIGS. 3A and 3B.

When the hypotoichoid apparatus is employed on an exercise machine, e.g., a stationary bicycle, it produces mechanical vibration during cycling. The mechanical vibration produces significant increases in muscle activation of the major lower limb muscles. During vibration, there is an increase in motor unit recruitment resulting in faster muscle activation. Vibration during cycling induces a greater training stimulus of the high-threshold fast twitch motor units. This equates with central nervous system activation lowering blood sugar levels, reducing triglycerides, increasing HDL cholesterol and lowering blood pressure resulting in weight loss and reduced risk of heart disease.

Additionally, mechanical vibration during cycling produces significant increases in the physiological demands (oxygen consumption and heart rate) confirmed by an increased exertion perceived by the subjects. Cycling at the same cadence with vibration seems to allow higher energy expenditure. Also, an increased neuromuscular recruitment has been confirmed with other studies using electromyography (EMG).

HORMESIS—Hormetic stress, or hormesis, is a beneficial type of stress. It is a small dose of stress that in large doses would be dangerous. It's the kind of stress from which a user can bounce back from and grow stronger as a result of having experienced it. A user's physical fitness can improve through short bursts of occasional stress, whether it's physical, chemical, mental or emotional. Hormesis encompasses the notion that low levels of stress stimulate or upregulate existing cellular and molecular pathways that improve the capacity of cells and organisms to withstand greater stress. This notion underlies much of what is known about how exercise conditions the body and induces longterm adaptations. During exercise, the body is exposed to various forms of stress, including thermal, metabolic, hypoxic, oxidative, and mechanical stress. These stressors activate biochemical messengers, which in turn activate various signaling pathways that regulate gene expression and adaptive responses.

To drive rotation of the eccentric hub 28, power from the spindle 20 is transmitted through a single-planet epicyclic or planetary gear assembly 38 comprising the single planetary gear 16 and the single ring gear 18, whose center-to-center distance coincides with the aforementioned eccentricity. This drives the single planetary gear 16, affixed to the spindle 20, to rotate around the circumference of the stationary single ring gear 18. An equal and opposite force drives the eccentric hub 28 to rotate in the opposing direction, thereby producing vibrations. The resultant path of travel 36 (see FIG. 1) produced by the rotation of the spindle 20 and eccentric hub 28 can be characterized as a hypotrochoid. The planetary gear assembly 38 with a small difference in number of teeth can be used produce high frequency vibrations.

Generally, a hypotrochoid apparatus comprises an inner assembly 12 coupled to an outer assembly 26. The inner assembly 12 comprises, a spindle 20, and at least one sealed ball bearing cartridge 48, 57. The spindle 20 is rotatably housed inside the inner assembly 12 and can rotate freely. The free rotation of the spindle 20 can be created by employing at least one ball bearing assembly, e.g., first angular contact ball bearing 46, 47 or inner bearing or second angular contact ball bearing 48, 57, such as a sealed ball bearing cartridge. The spindle 20 comprises proximal end 54 and a distal end 52, and the distal end 52 can be modified to comprise at least one groove 56 that runs around an outer circumference of the spindle 20 for engaging an inner retainer ring 64, and a key 22 positioned parallel to the longitudinal length of the spindle 20. The inner assembly can also comprise an eccentric hub 28.

The eccentric hub 28 drives the vibration of the hypotrochoid apparatus 10 by producing vibration at the spindle 20, and comprises an eccentric inner throughbore 80, an outer surface, an inner surface, a distal end 76 and a proximal end 78, and inner threading 83 on the inner surface of the distal end 76 and the proximal end 78. The eccentric inner throughbore 80 can be eccentric from 0.25 mm to 2.5 mm, or any measurement therebetween, including fractional increments of the measurement, from the outer surface of the eccentric hub 28. As an example, the eccentric inner throughbore 80 can be eccentric from 0.25 mm, 0.5 mm, 0.75 mm, 0.9 mm, 0.925 mm, 0.950 mm, 0.975 mm. 0.990 mm, 1.0 mm, 1.05 mm, 1.10 mm, 1.15 mm, 1.25 mm, 1.5 mm, 1.75 mm, 2.0 mm, 2.25 mm, 2.5 mm. The spindle 20 can be engaged with, and housed within, the eccentric inner throughbore 80, and coupled to the eccentric inner throughbore 80 by utilizing a first seal housing 112 at the distal end of the inner housing and a second seal housing 114 at the proximal end of the inner housing. The first seal housing 112 and the second seal housing 114 can each comprise means for engaging the threads on the inner surface of the eccentric hub 28.

The inner assembly 12 can also comprise a first angular contact ball bearing 46, 47 and a second angular contact ball bearing 48, 57. The first angular contact ball bearing 46, 47, and second angular contact ball bearing 48, 57 can be used to support the weight of the user on the exercise equipment. The first angular contact ball bearing 46, 47 can comprise a distal side and a proximate side, and be centrally mounted around the outer surface of the eccentric hub 28. The second angular contact ball bearing 48, 57 can comprise a distal side and a proximate side, and be centrally mounted around the outer surface of the eccentric hub 28. The first angular contact ball bearing 46 and the first angular contact ball bearing 47 can abut each other, wherein the proximate side of the first angular contact ball bearing 46 abuts the distal side of the first angular contact ball bearing 47.

The first angular contact ball bearing 46, 47 and the second angular contact ball bearing 48, 57 can be locked in place on the outer surface of the eccentric hub 28. A first lock washer 49 can be engaged with the distal side of the first angular contact ball bearing 46, 47 and a second lock washer 51 can be engaged with the proximate side of the second angular contact ball bearing 48, 57. Further, a first lock nut 53 can be engaged with the first lock washer 49 and a second lock nut 55 can be engaged with the second lock washer 51, to secure the first angular contact ball bearing 46, 47 and the second angular contact ball bearing 48, 57 in place.

The inner assembly 12 can also comprise a portion of the planetary gear assembly 38. The planetary gear assembly 38 can comprise a single planetary gear 16 that can be attached directly to the spindle 20. The single planetary gear 16 can comprise a key way 70 for engaging the key 22 located on the outer surface of the spindle 20. The single planetary gear 16 can comprise ring teeth 74 surrounding the outer circumference the single planetary gear 16, and a central opening 72 for allowing the spindle to pass through the center of the single planetary gear 16.

The outer assembly 26 can comprise an outer housing 32 being cylindrically shaped and having a proximate end and a distal end, a first retaining ring 105 being positioned inside the outer housing 32 at the proximate end of the outer housing 32. The outer housing 32 can be used to retain the inner assembly 12 and comprises a hollow interior. The outer assembly 26 can also comprise a rotor clutch assembly 92. The rotor clutch assembly 92 can be a machined disc or a gear bearing adapter, comprising a central throughbore for receiving the inner assembly, wherein the rotor clutch assembly 92 is positioned at the distal end of the outer hollow housing. The rotor clutch assembly 92 can be attached to the outer housing 32 using fasteners, such as screws. The rotor clutch assembly can be in mechanical communication with the clutch system 129.

The outer assembly 26 comprises the other portion of the planetary gear train, where the other portion of the planetary gear assembly 38 comprises a single ring gear 19 comprising ring teeth 74 surrounding an inner circumference of the single ring gear 18 for meshing with the teeth 66 surrounding the outer circumference of the single planetary gear 16 of the inner assembly 12. The single ring gear 18 can be coupled to an outer edge of the central opening 68 of the single planetary gear 16.

The inner assembly 12 can be inserted into the outer assembly 26 through the throughbore of the outer assembly 26, and a ring shaped shim 98 comprising a central opening 100, an inner surface 102, and an outer surface 104 can be placed on the proximate end of the inner assembly 12 to close a gap between the first retaining ring 105 and the proximate end of the outer hollow housing after the inner assembly 12 is concentrically coupled within the outer hollow housing, wherein the inner surface 102 of the ring shaped shim 98 is abutted against the first retaining ring 105.

A second retaining ring 106 can be positioned inside the proximate end of the housing 14 and abutted against the outer surface 104 of the ring shaped shim 98, and a cover end 60 can be placed over the proximate end of the housing 14 to enclose the inner assembly 12 in the outer assembly 26.

The hypotrochoid apparatus 10 comprises the inner assembly 12 concentrically coupled within the outer assembly 26.

The hypotrochoid apparatus 10 can comprise a spindle 20 having mechanical interfaces 21 (see FIGS. 51 and 52) located at each end of the spindle 20, and a crank arm 34 can be coupled to each mechanical interface 21.

Figure 4:
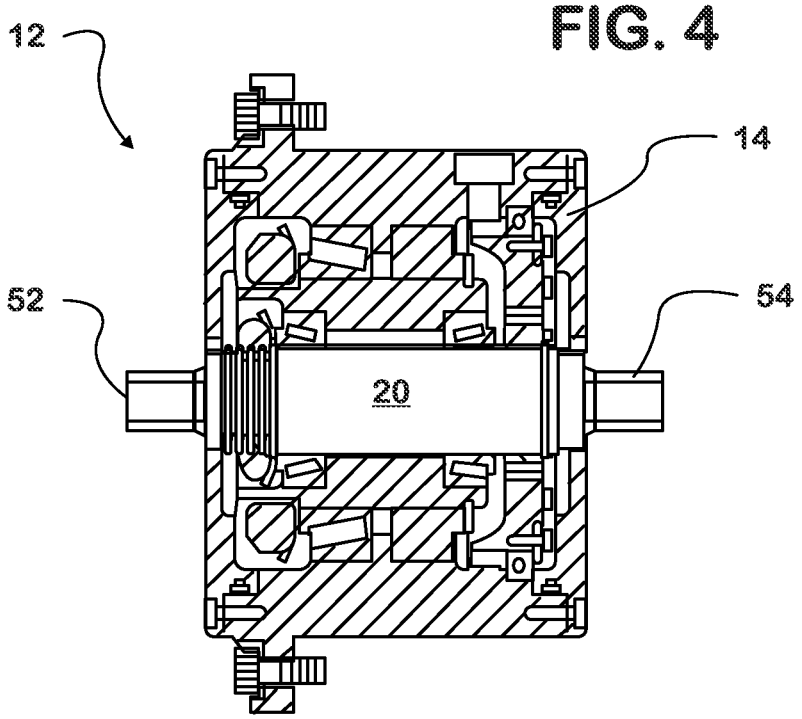
FIG. 4 illustrates a cross-section plan view of an embodiment of the gear box assembly in accordance with the principles of the present disclosure.

Turning to FIG. 4, a side plan cross section view of one embodiment of the inner assembly 12 is illustrated. The spindle 20 comprises a distal end 52 and a proximal end 54 and at least one groove 56 is seated inside the housing cavity 58 of the housing 14.

Figure 5:
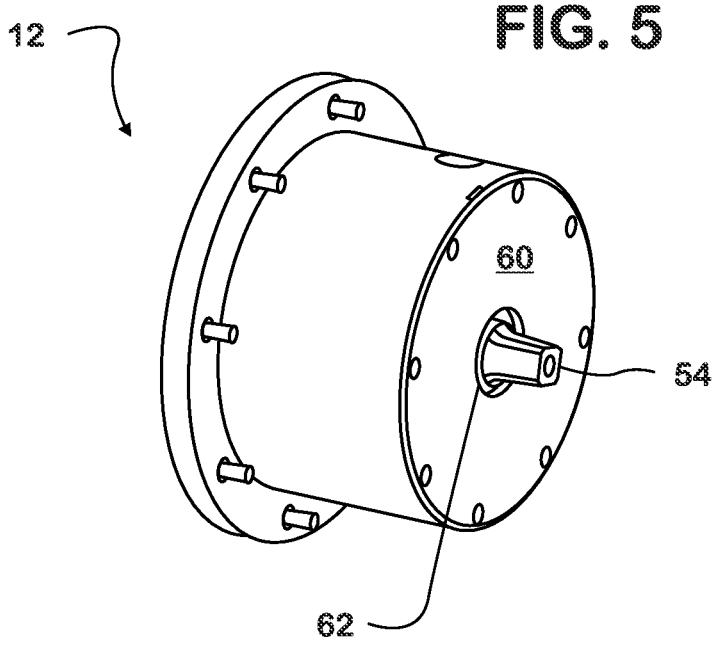
FIG. 5 illustrates a perspective cross section view of an embodiment of the inner assembly coupled to the outer assembly of a hypotrochoid assembly in accordance with the principles of the present disclosure.

Turning to FIG. 5, a perspective view of at least one embodiment of the housing 14 is illustrated. The proximal end 54 of the spindle 20 extends out of the cover end 60 through a cover end opening 62.

Figure 6:
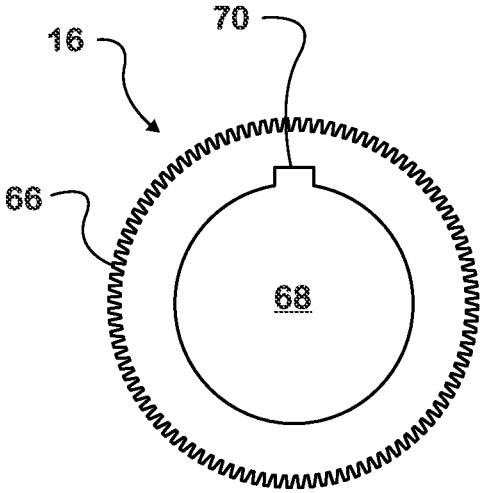
FIG. 6 illustrates a front plan view of an embodiment of the single planet gear in accordance with the principles of the present disclosure.
Figure 7:
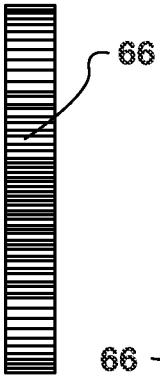
FIG. 7 illustrates a side plan view of an embodiment of the single planet gear in accordance with the principles of the present disclosure.
Figure 8:
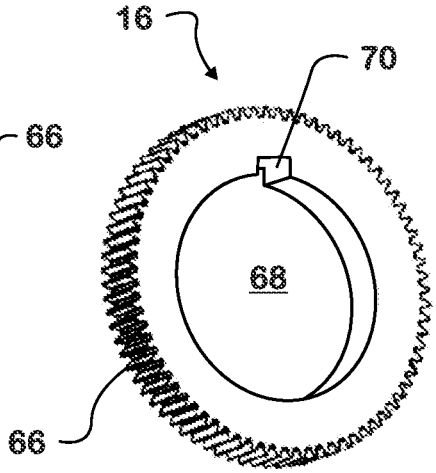
FIG. 8 illustrates a bottom perspective view of an embodiment of the single planet gear in accordance with the principles of the present disclosure.

Turning to FIGS. 6-8, at least one embodiment of the single planetary gear 16 is illustrated in different views. The single planetary gear 16 comprises teeth 66 along the outer surface. The single planetary gear 16 comprises a central opening 68 and a key way 70 for accepting the key 22.

Figure 9:
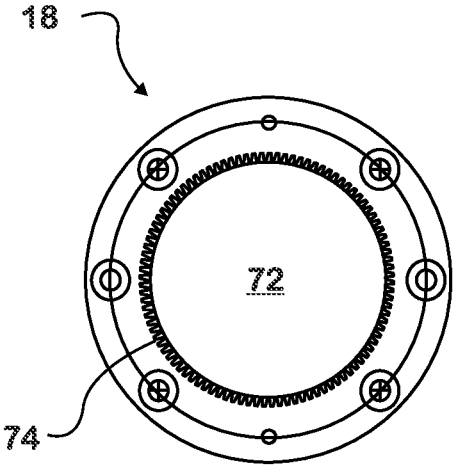
FIG. 9 illustrates a front plan view of an embodiment of a single ring gear accordance with the principles of the present disclosure.
Figure 10:
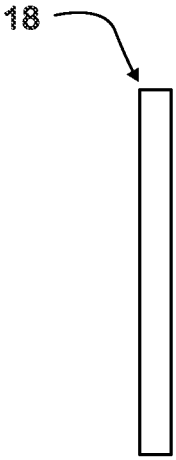
FIG. 10 illustrates a side plan view of an embodiment of a single ring gear in accordance with the principles of the present disclosure.
Figure 11:
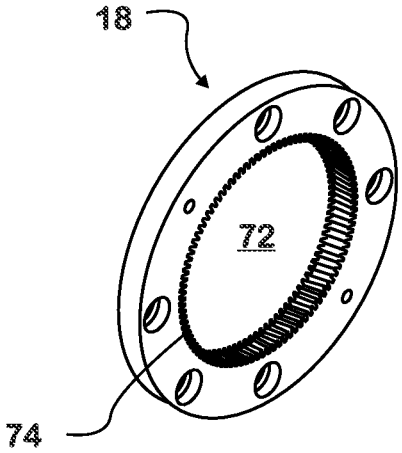
FIG. 11 illustrates a top perspective view of an embodiment of a single ring gear in accordance with the principles of the present disclosure.
Figure 12:
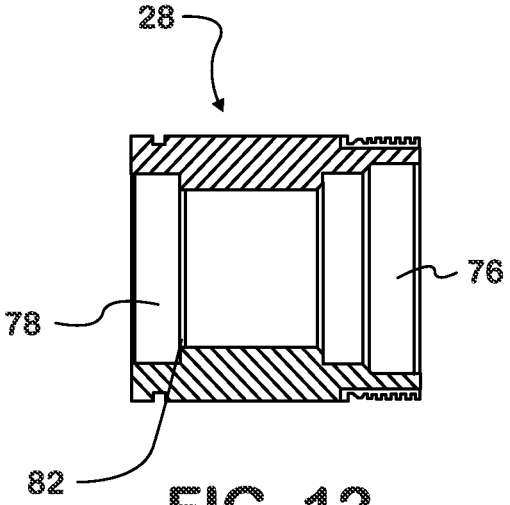
FIG. 12 illustrates a side longitudinal cross-section view of an embodiment of an eccentric hub in accordance with the principles of the present disclosure.
Figure 13:
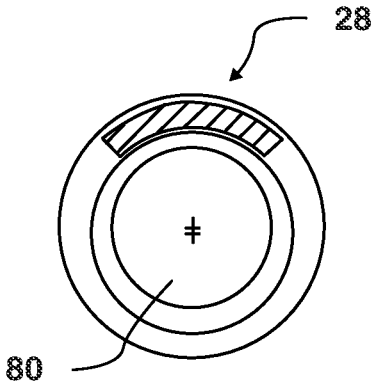
FIG. 13 illustrates a front plan view of an embodiment of an eccentric hub in accordance with the principles of the present disclosure.
Figure 14:
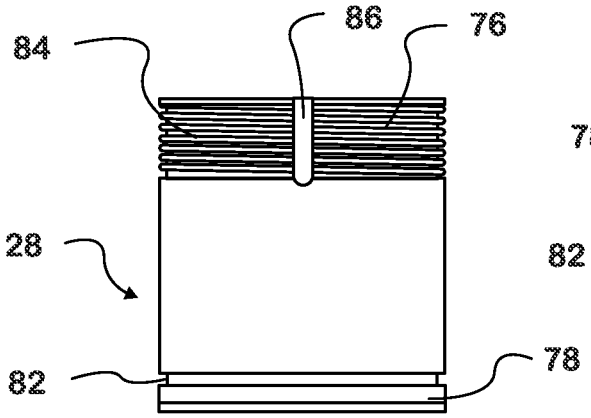
FIG. 14 illustrates a side plan view of an embodiment of an eccentric hub in accordance with the principles of the present disclosure.
Figure 15:
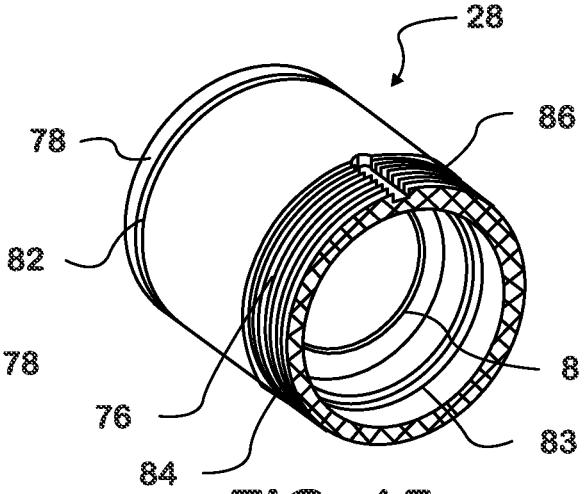
FIG. 15 illustrates a top perspective view of an embodiment of an eccentric hub in accordance with the principles of the present disclosure.

Turning to FIGS. 9-11, at least one embodiment of the single ring gear 18 is illustrated. The single ring gear 18 comprises a central opening 72 and ring teeth 74 on the inner surface of the single ring gear 18.

Turning to FIGS. 12-15, at least one embodiment of the eccentric hub 28 is illustrated. The eccentric hub 28 comprises a distal end 76 and a proximal end 78 and can produce mechanical perturbations or vibrations in a spindle 20. The frequency and amplitude of these perturbations are determined by the eccentric hub 28 angular velocity and geometric eccentricity, respectively. An outer bearing or first angular contact ball bearing 46 (see FIGS. 3A and 3B) support the eccentric hub 28 about a fixed axis and an inner bearing or second angular contact ball bearing 48 (see FIGS. 3A and 3B) or at least one sealed bearing cartridge allows the spindle 20 to spin freely within the eccentric inner throughbore 80 of the eccentric hub 28 about a moving axis. The rotation of the eccentric hub 28 can be achieved by transmitting power from the spindle 20 via epicyclic gearing or a planetary gear assembly 38 comprising a single planetary gear 16 and a single ring gear 18. The center-to-center distance of the gearing can be designed to coincide with the aforementioned eccentricity. The single planetary gear 16, affixed to the spindle 20, rotates along the inner circumference of a single ring gear 18 when supplied mechanical power. Simultaneously, a reactionary force produced about the center of the single planetary gear 16 drives the eccentric hub 28 to rotate in the opposite direction of the spindle 20.

The proximate end 78 of the eccentric hub 28 comprises at least one groove 82 for accepting an inner retainer ring 64. The distal end 76 of the eccentric hub comprises threading 84 and a furrow 86 that runs perpendicular to the threading 84 on the outer surface of the distal end 76.

Figure 16:
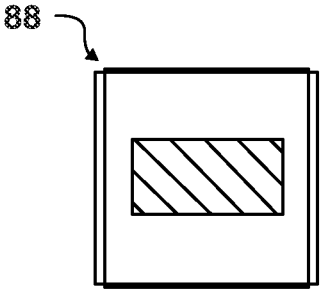
FIG. 16 illustrates a side longitudinal cross sectional view of an embodiment of an inner assembly hollow housing in accordance with the principles of the present disclosure.
Figure 17:
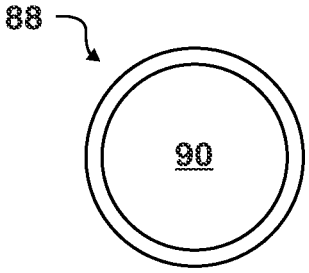
FIG. 17 illustrates a front plan view of an embodiment of an inner assembly hollow housing in accordance with the principles of the present disclosure.
Figure 18:
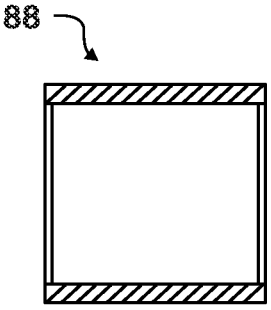
FIG. 18 illustrates a side plan view of an embodiment of an inner assembly hollow housing in accordance with the principles of the present disclosure.
Figure 19:
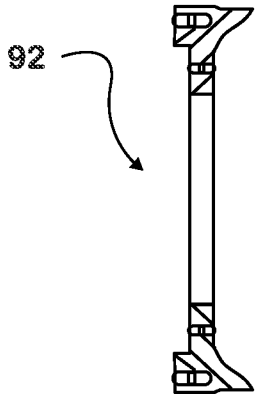
FIG. 19 illustrates a side view of an embodiment of a rotor clutch assembly in accordance with the principles of the present disclosure.
Figure 21:
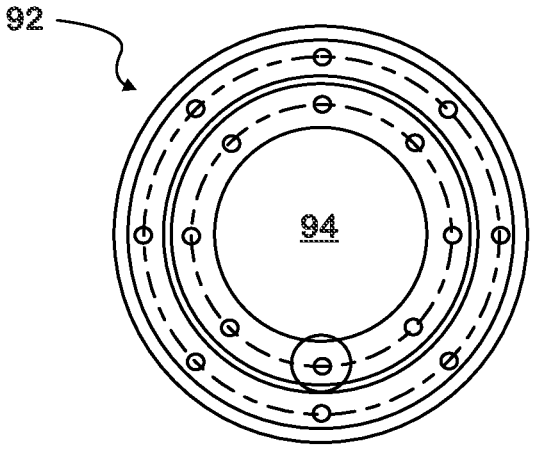
FIG. 21 illustrates a front plan view of an embodiment of a rotor clutch assembly in accordance with the principles of the present disclosure.
Figure 20:
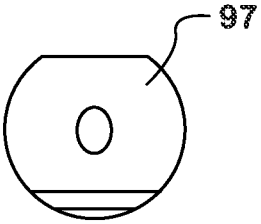
FIG. 20 illustrates a front plan view of an embodiment of the coupling connection of a rotor clutch assembly in accordance with the principles of the present disclosure.
Figure 22:
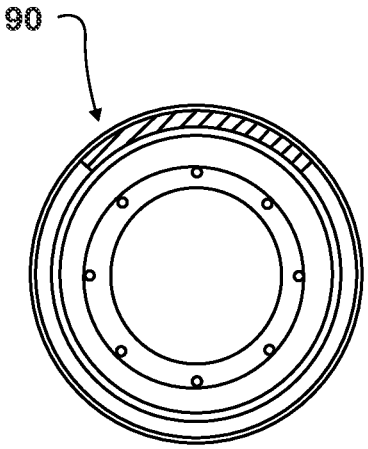
FIG. 22 illustrates a front plan view of an embodiment of a rotor clutch assembly in accordance with the principles of the present disclosure.
Figure 23:
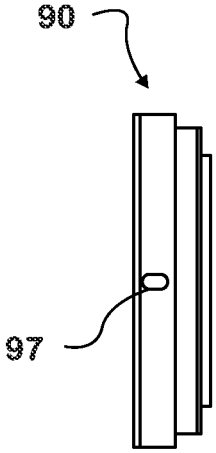
FIG. 23 illustrates a side plan view of an embodiment of a rotor clutch assembly in accordance with the principles of the present disclosure.
Figure 24:
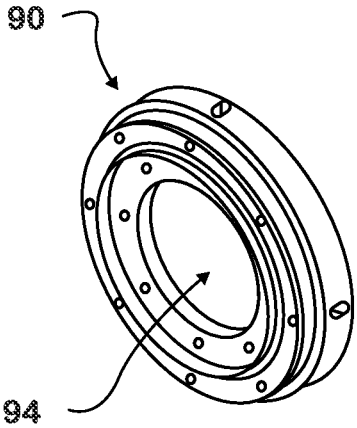
FIG. 24 illustrates a top perspective view of an embodiment of a rotor clutch assembly in accordance with the principles of the present disclosure.

Turning to FIGS. 16-18, at least one embodiment of the inner assembly hollow 88 is illustrated. The inner assembly hollow 88 is cylindrical in shape and comprises a central opening 90.

The vibration produced by the planetary gear assembly 38 can be characterized as a hypotrochoid centered about the fixed axis. The form of the hypotrochoid can be shaped by varying the distance of the output about the fixed axis by attaching a crank arm 34 or similar mechanical element to the spindle 20. The number of vibrations per crank revolution depends on the gear ratio, calculated by the difference in number of teeth normalized into the number of teeth on the single planetary gear 16. Gearing with a small difference in numbers of teeth can be used to generate relatively high frequency and low amplitude vibrations.

Turning to FIGS. 19-24, at least one embodiment of the rotor clutch assembly is illustrated. Generally, a clutch mechanism can be used to engage and disengage the eccentric hub 28 and vibration of the spindle 20. The single ring gear 18 can be supported by a four-point rolling bearing 96 within a stationary Gearbox housing or rotor clutch assembly 92. The rotor clutch assembly 92 can contain a catch feature or coupling 97 (see FIG. 20). A radially mounted long-nose spring plunger, when extended into the key way 70, prevents the single ring gear 18 from rotating. While locked, power can be coupled to the eccentric hub 28 to engage vibration. When retracted, the single ring gear 18 can rotate freely, effectively decoupling power to inhibit vibration.

Figure 25:
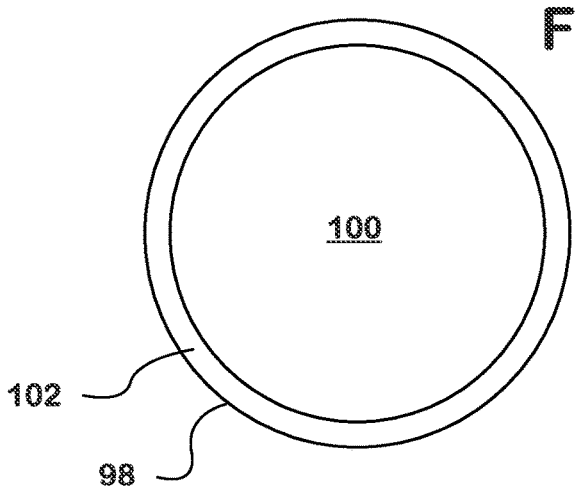
FIG. 25 illustrates a front plan view of an embodiment of a ring shaped shim in accordance with the principles of the present disclosure.
Figure 26:
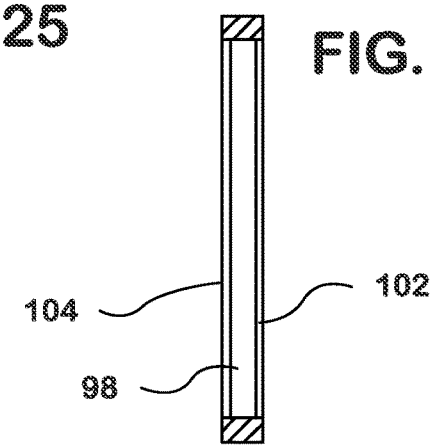
FIG. 26 illustrates a side plan view of an embodiment of a ring shaped shim in accordance with the principles of the present disclosure.
Figure 27:
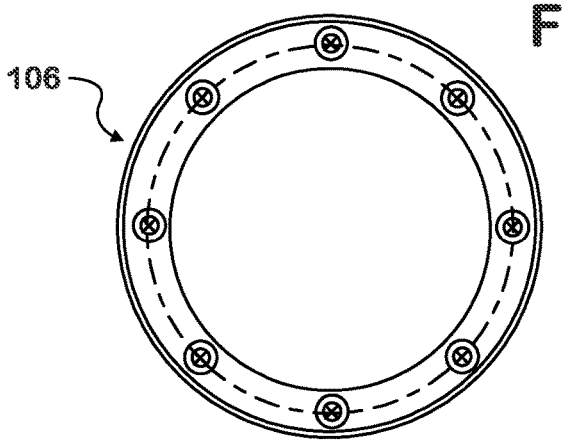
FIG. 27 illustrates a front plan view of an embodiment of a second retaining ring in accordance with the principles of the present disclosure.
Figure 28:
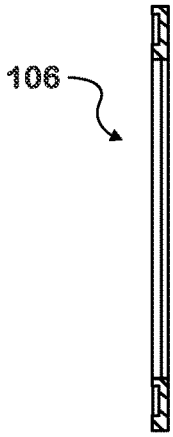
FIG. 28 illustrates a side plan view of an embodiment of a second retaining ring in accordance with the principles of the present disclosure.
Figure 29:
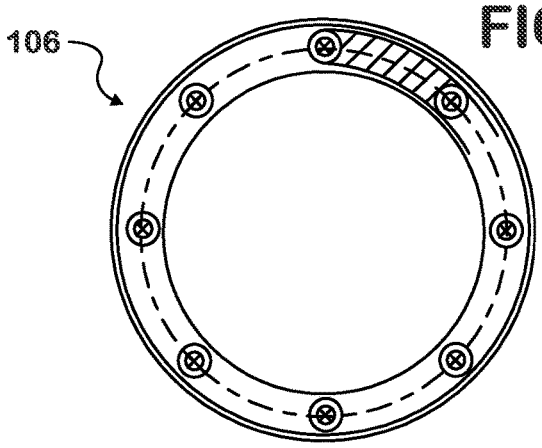
FIG. 29 illustrates a front plan view of an embodiment of a second retaining ring in accordance with the principles of the present disclosure.
Figure 30:
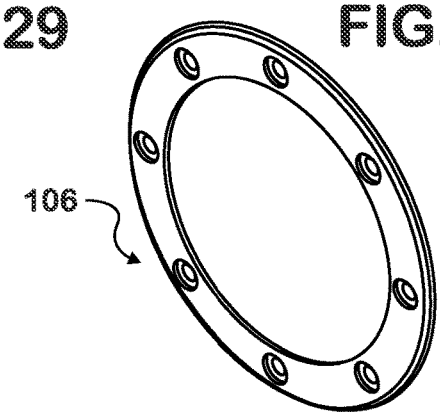
FIG. 30 illustrates a top perspective view of an embodiment of a second retaining ring in accordance with the principles of the present disclosure.
Figure 31:
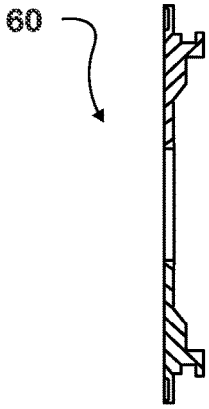
FIG. 31 illustrates a side plan view of an embodiment of an end cover in accordance with the principles of the present disclosure.
Figure 32:
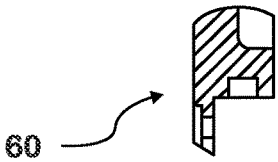
FIG. 32 illustrates a side plan view of an embodiment of a portion of an end cover in accordance with the principles of the present disclosure.
Figure 33:
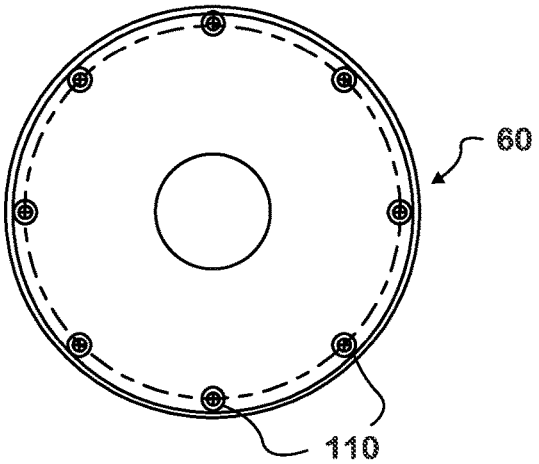
FIG. 33 illustrates a front plan view of an embodiment of an end cover in in accordance with the principles of the present disclosure.
Figure 34:
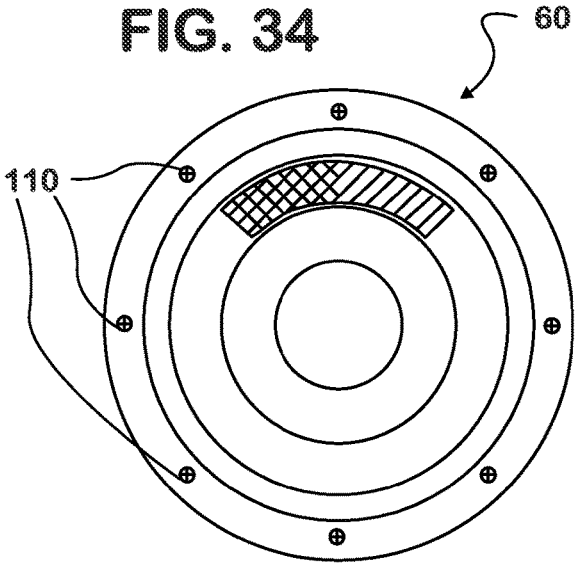
FIG. 34 illustrates a rear plan view of an embodiment of an end cover in accordance with the principles of the present disclosure.
Figure 35:
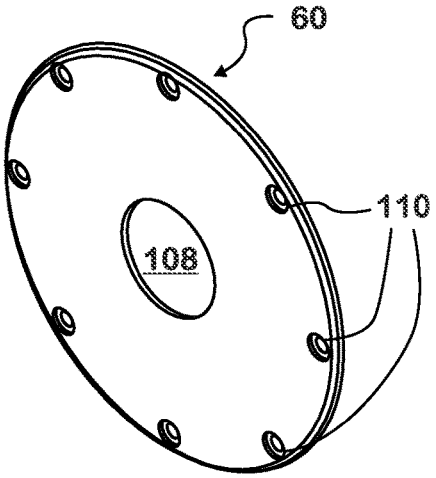
FIG. 35 illustrates a top perspective view of an embodiment of an end cover in accordance with the principles of the present disclosure.
Figure 36:
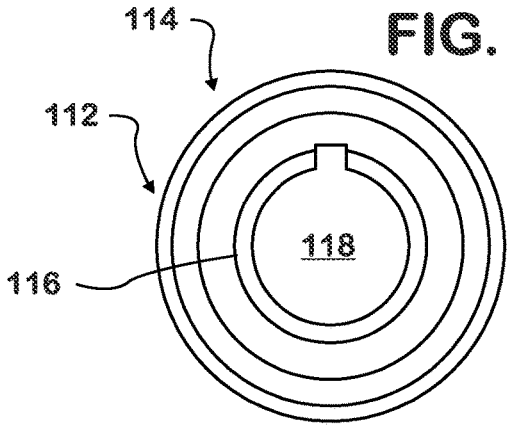
FIG. 36 illustrates a front plan view of an embodiment of a seal housing for an inner assembly in accordance with the principles of the present disclosure.
Figure 37:
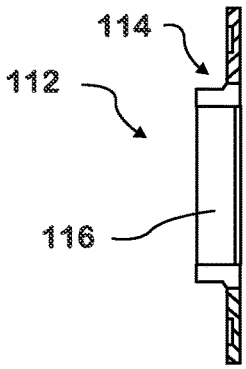
FIG. 37 illustrates a side plan view of an embodiment of a seal housing for an inner assembly in accordance with the principles of the present disclosure.
Figure 38:
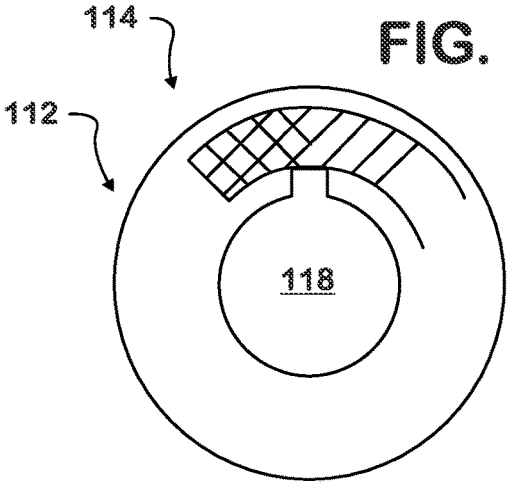
FIG. 38 illustrates a rear plan view of an embodiment of a seal housing for an inner assembly in accordance with the principles of the present disclosure.
Figure 39:
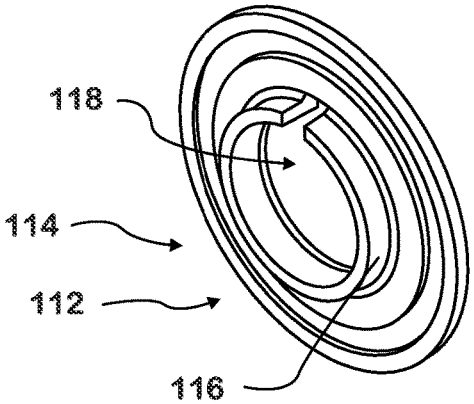
FIG. 39 illustrates a top perspective view of an embodiment of a seal housing for an inner assembly in accordance with the principles of the present disclosure.

Turning to FIGS. 25-26, a ring shaped shim 98 is illustrated in different views. The ring shaped shim 98 comprises a central opening 100, an inner surface 102, and an outer surface 104 for closing a gap between the first retaining ring 105 and the proximate end of the outer housing 32 after the inner assembly 12 is concentrically coupled within the outer housing 32, wherein the inner surface of the shim is abutted against the inner retaining ring 64.

Turning to FIGS. 27-30, at least one embodiment of a second retaining ring 106 is illustrated. The second retaining ring 106 can be positioned inside the proximate end of the outer hollow housing and abutted against the outer surface 104 of the ring shaped shim 98.

Turning to FIGS. 31-35, at least one embodiment of a cover end 60 is illustrated in multiple views. The cover end 60 comprises a central opening 108, and a plurality of holes 110 for accepting a fastener. The cover end 60 is placed over each end of the hypotrochoid apparatus 10 to protect the inner workings of the hypotrochoid apparatus 10.

Turning to FIGS. 36-39, at least one embodiment of a first seal housing 112 and a second seal housing 114 are illustrated. The first seal housing 112 and the second seal housing 113 are identical to each other. The first seal housing 112 and the second seal housing 114 can each comprise means for engaging the inner threads 83 on the inner surface of the eccentric hub 28. The first seal housing 112 and second seal housing each comprise an outer rim 116 and a centrally located seal housing throughbore 118 for accepting the spindle 20.

Figure 40:
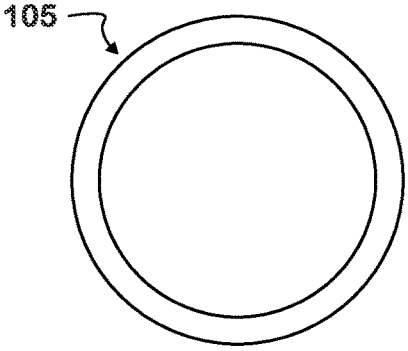
FIG. 40 illustrates a front plan view of an embodiment of a first retaining ring in accordance with the principles of the present disclosure.
Figure 41:
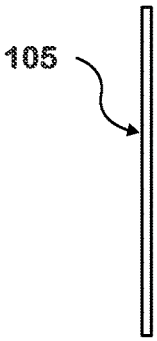
FIG. 41 illustrates a side plan view of an embodiment of a first retaining ring in accordance with the principles of the present disclosure.
Figure 42:
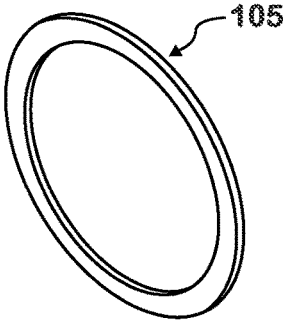
FIG. 42 illustrates a top perspective view of an embodiment of a first retaining ring in accordance with the principles of the present disclosure.

Turning to FIGS. 40-42, at least one embodiment for a first retaining ring 105 is shown in different views.

Figure 43:
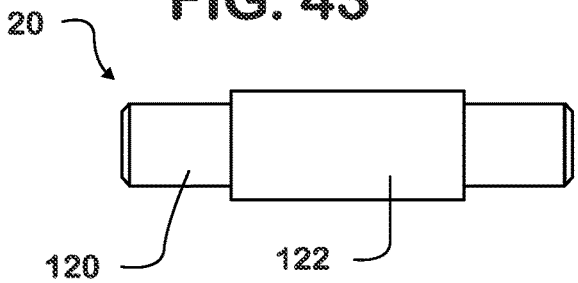
FIG. 43 illustrates a side plan view of an embodiment of a spindle in accordance with the principles of the present disclosure.
Figure 44:
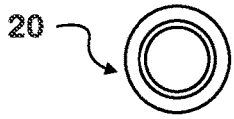
FIG. 44 illustrates a front plan view of an embodiment of a spindle in accordance with the principles of the present disclosure.
Figure 45:
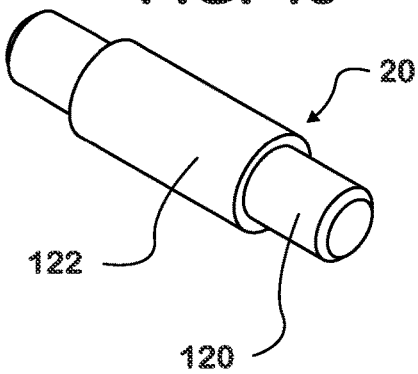
FIG. 45 illustrates a top perspective view of an embodiment of a spindle in accordance with the principles of the present disclosure.
Figure 46:
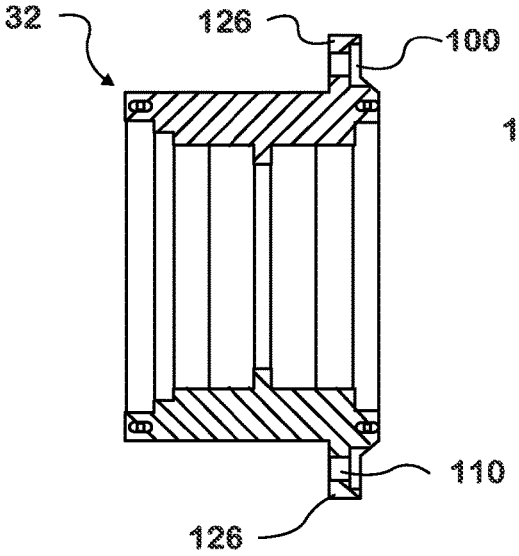
FIG. 46 illustrates a side cross section view of an embodiment of an outer housing in accordance with the principles of the present disclosure.
Figure 47:
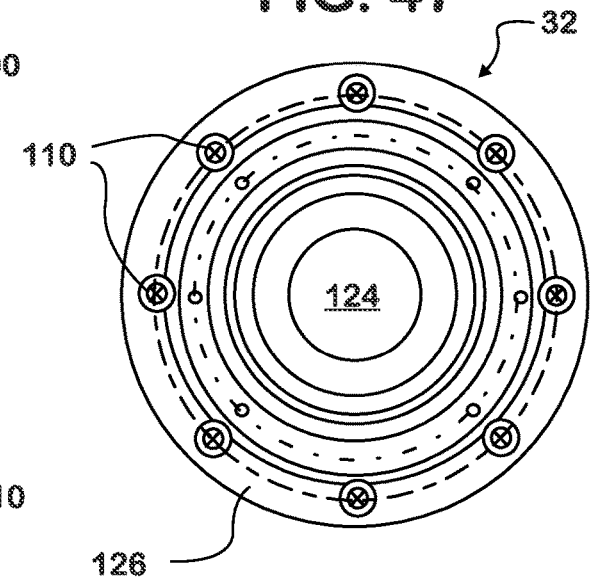
FIG. 47 illustrates a front plan view of an embodiment of an outer housing in accordance with the principles of the present disclosure.
Figure 48:
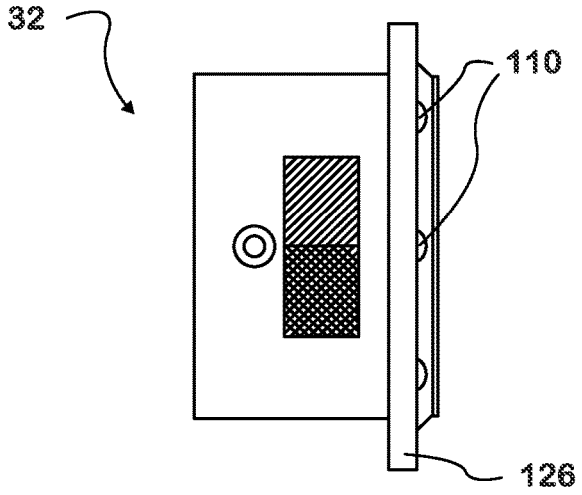
FIG. 48 illustrates a side plan view of an embodiment of an outer housing in accordance with the principles of the present disclosure.
Figure 49:
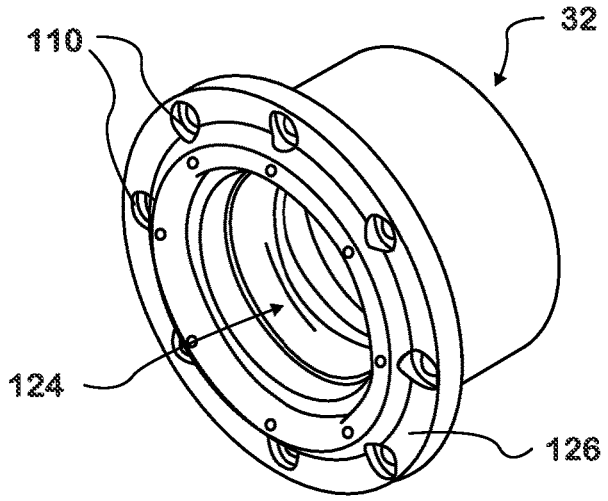
FIG. 49 illustrates a top perspective view of an embodiment of an outer housing in accordance with the principles of the present disclosure.

Turning to FIGS. 43-45, at least one embodiment for the spindle 20 is shown in different views. The spindle 20 comprises a spindle rod 120 and a spindle sleeve 122. The spindle sleeve 122 can freely rotate about the spindle rod 120.

Turning to FIGS. 46-49, at least one embodiment of the outer housing 32 is illustrated in different views. The outer housing 32 comprises a centrally located outer housing throughbore 124. The outer housing also comprises a lip 126 comprises a plurality of holes 110 to accept fasteners. The inside surface of the housing may comprise threading, if desired.

Figure 50:
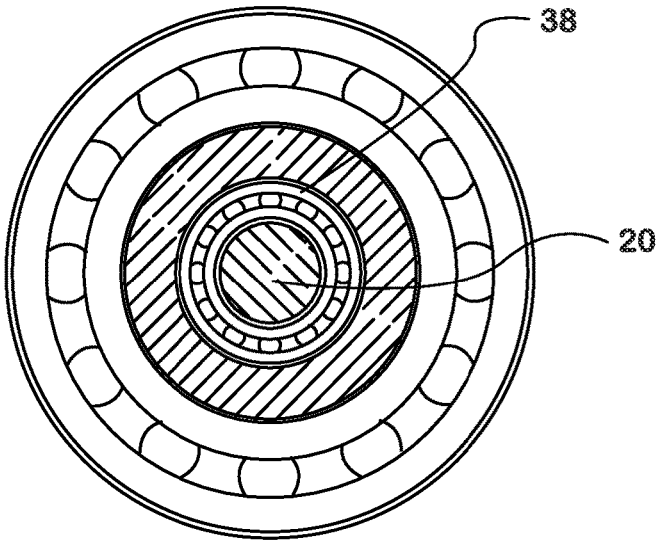
FIG. 50 illustrates a front plan view of an embodiment of an inner assembly in accordance with the principles of the present disclosure.

Turning to FIG. 50, an exemplary embodiment of the inner assembly 12 is illustrated comprising at least the spindle 20 and the planetary gear assembly 38.

Figure 51:
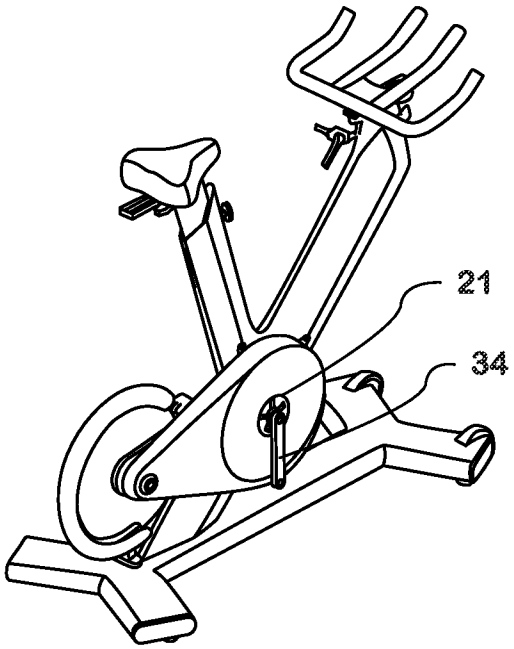
FIG. 51 illustrates a top perspective view of an embodiment of an assembled exercise machine in accordance with the principles of the present disclosure.

Turning to FIG. 51, an exemplary embodiment of an exercise machine is illustrated in an assembled form. The hypotrochoid apparatus 10 is employed by the exercise machine and the crank arm 34 is engaged to the spindle 20.

Figure 52:
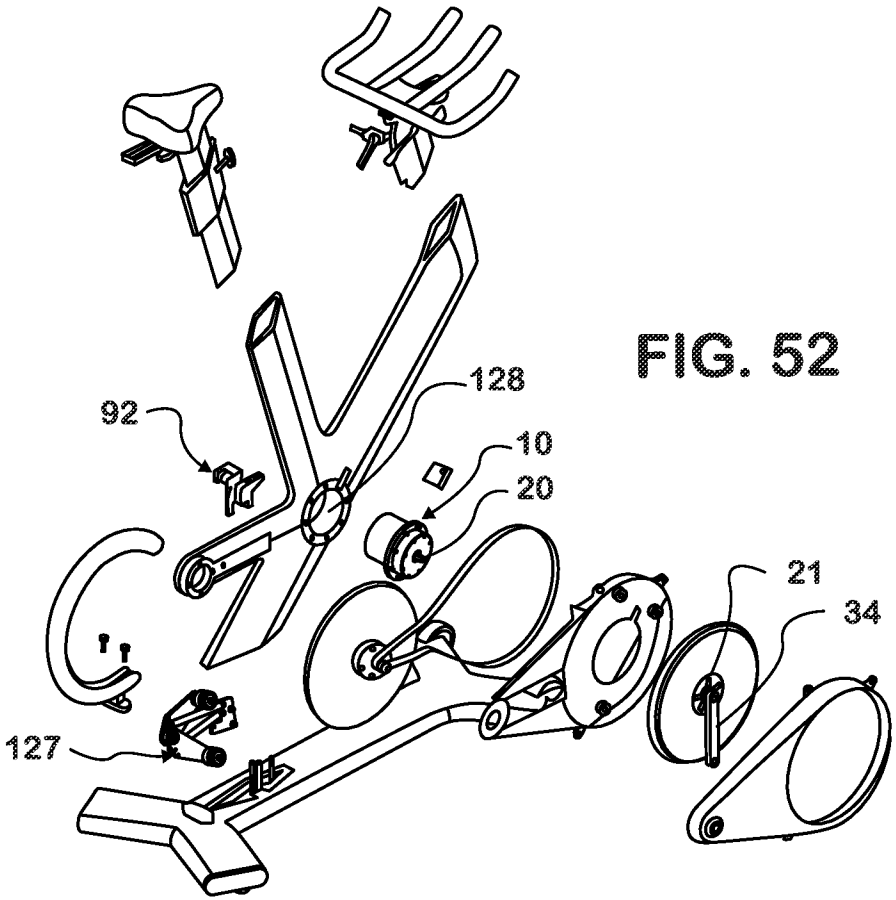
FIG. 52 illustrates an exploded view of an embodiment of an exercise machine in accordance with the principles of the present disclosure.

Turning to FIG. 52, an exemplary embodiment of an exercise machine is illustrated in an exploded view. The hypotrochoid apparatus 10 may comprise a belt tensioner system 127. Some exercise machines comprise a belt or a chain to drive rotation of a portion of the exercise machine. If the exercise machine is a bicycle, the belt or chain can transfer rotational movement of the pedals to the wheels of the bicycle. The belt tensioner system 127 can be engaged to a belt to reduce slipping of the belt when the clutch system 129 is engaged and causing the hypotrochoid apparatus to create vibration. The hypotrochoid apparatus 10 is inserted into an exercise machine slot 128 configured to accept the hypotrochoid apparatus 10. The rotor clutch assembly 92 is engaged to the hypotrochoid apparatus 10 to control the vibration pattern of the hypotrochoid assembly.

Figure 53:
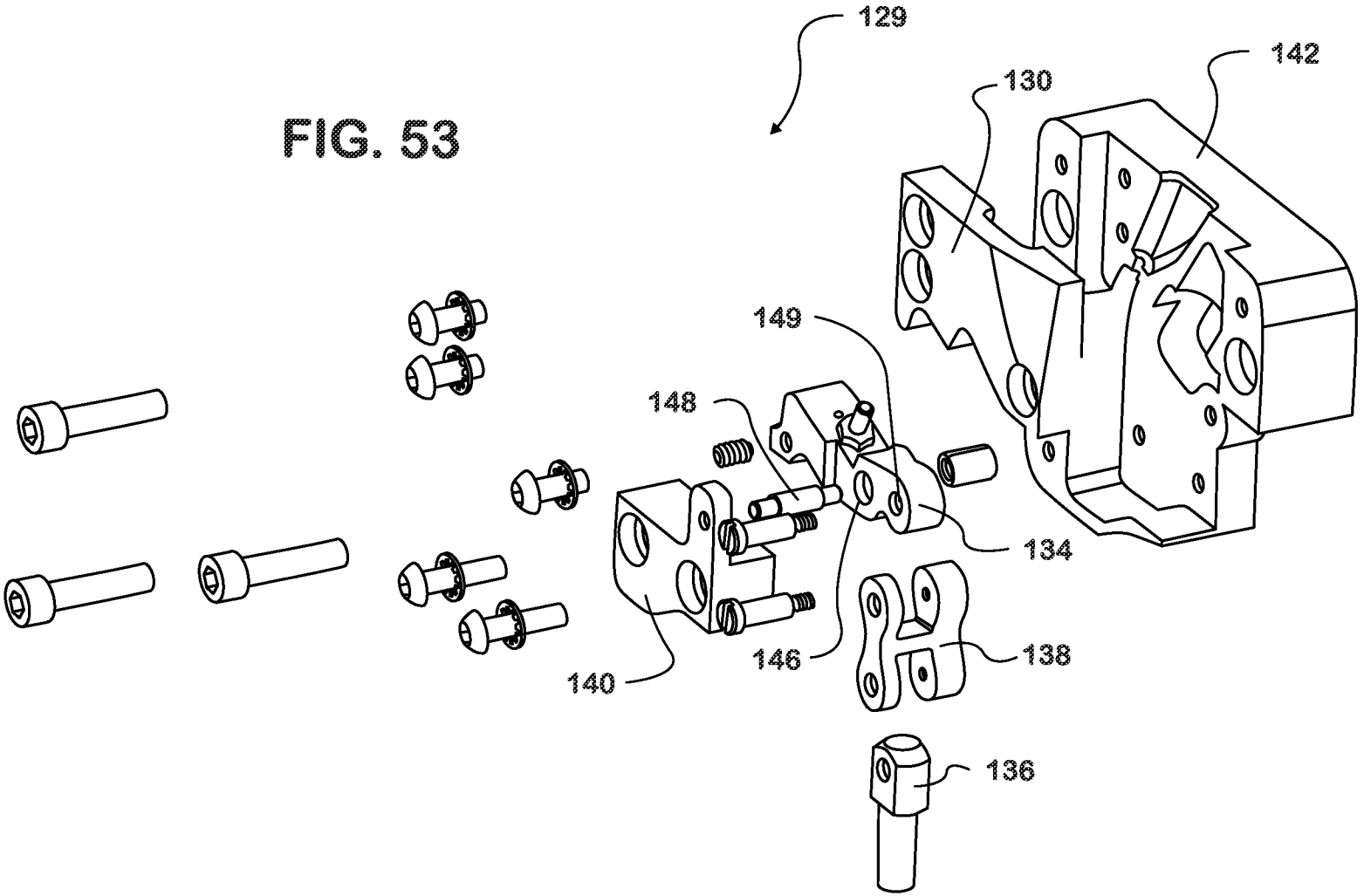
FIG. 53 illustrates an exploded view of an embodiment of a clutch system in accordance with the principles of the present disclosure.
Figure 54:
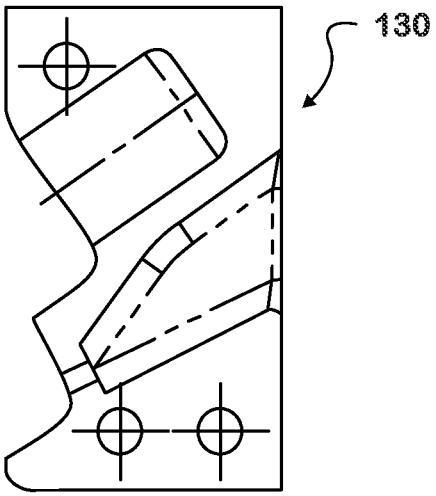
FIG. 54 illustrates a right side plan view of an embodiment of a cable mount cover in accordance with the principles of the present disclosure.
Figure 55:
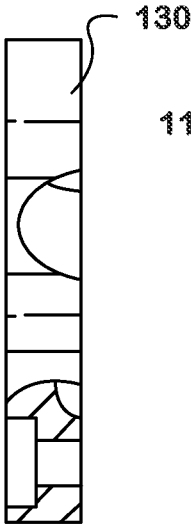
FIG. 55 illustrates a rear plan view of an embodiment of a cable mount cover in accordance with the principles of the present disclosure.
Figure 56:
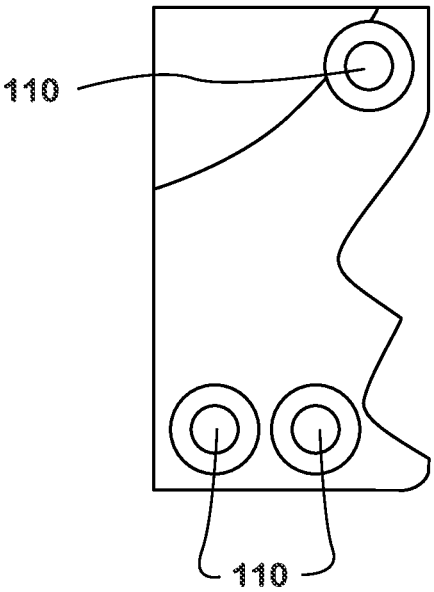
FIG. 56 illustrates a left side plan view of an embodiment of a cable mount cover in accordance with the principles of the present disclosure.
Figure 57:
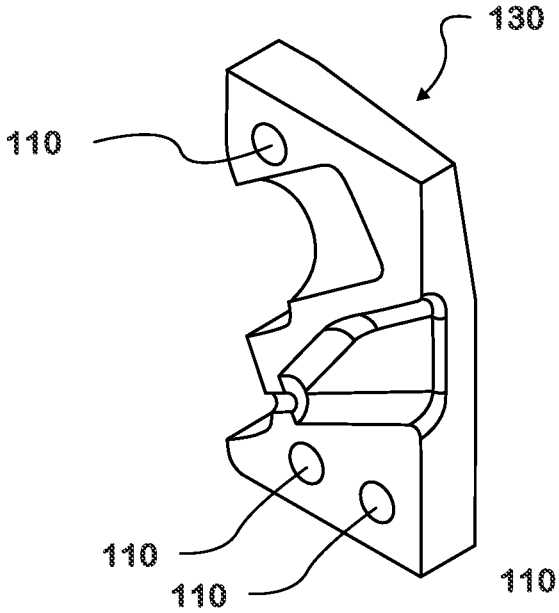
FIG. 57 illustrates a right top perspective view of an embodiment of a cable mount cover in accordance with the principles of the present disclosure.
Figure 58:
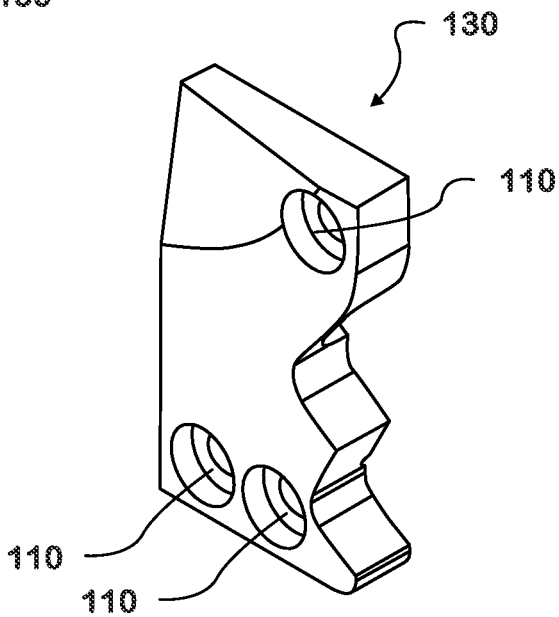
FIG. 58 illustrates a left top perspective view of an embodiment of a cable mount cover in accordance with the principles of the present disclosure.
Figure 59:
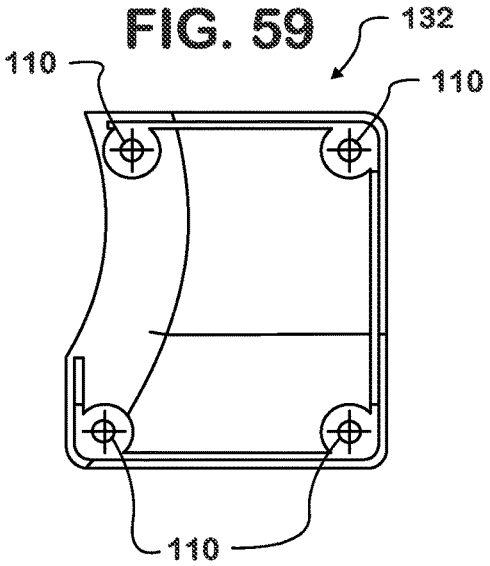
FIG. 59 illustrates a right side plan view of an embodiment of a clutch cover in accordance with the principles of the present disclosure.
Figure 60:
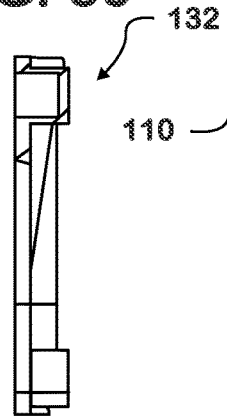
FIG. 60 illustrates a rear plan view of an embodiment of a clutch cover in accordance with the principles of the present disclosure.
Figure 61:
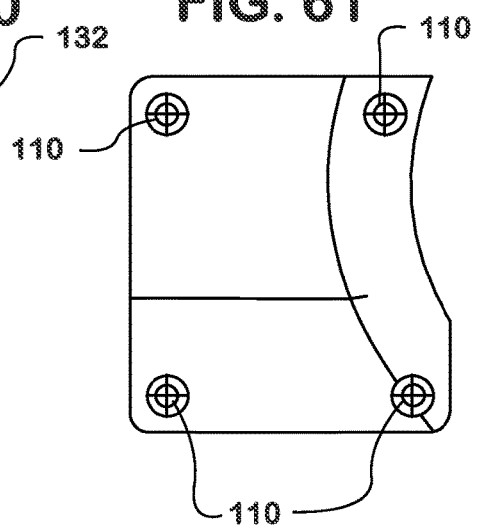
FIG. 61 illustrates a left side plan view of an embodiment of a clutch cover in accordance with the principles of the present disclosure.
Figure 62:
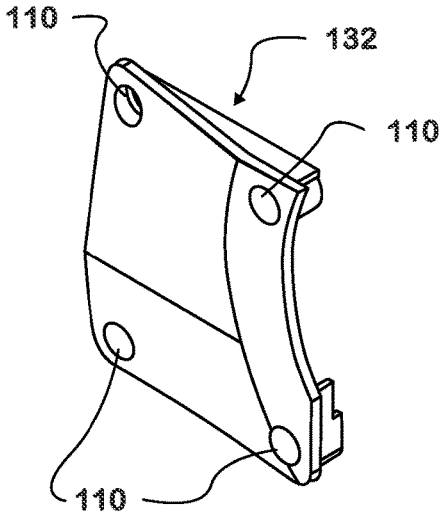
FIG. 62 illustrates a top perspective view of an embodiment of a clutch cover in accordance with the principles of the present disclosure.
Figure 63:
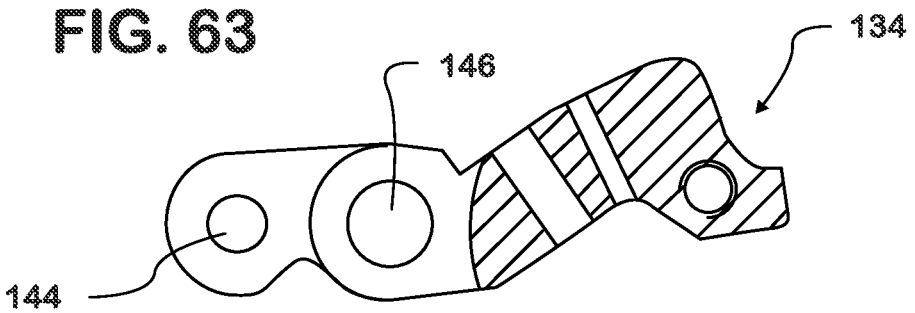
FIG. 63 illustrates a side plan view of an embodiment of a clutch lever in accordance with the principles of the present disclosure.
Figure 64:
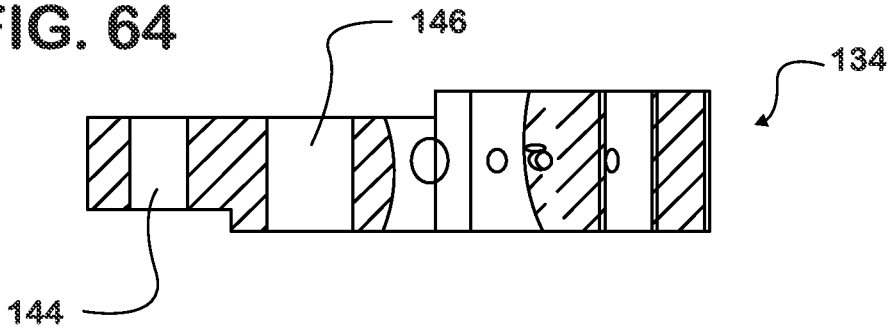
FIG. 64 illustrates a bottom plan cross sectional view of an embodiment of a clutch lever in accordance with the principles of the present disclosure.
Figure 65:
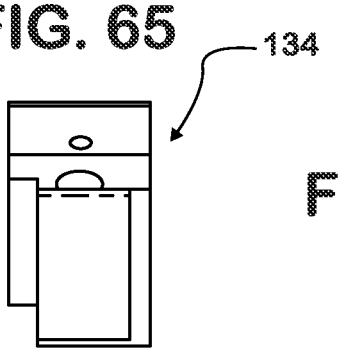
FIG. 65 illustrates a rear plan view of an embodiment of a clutch lever in accordance with the principles of the present disclosure.
Figure 66:
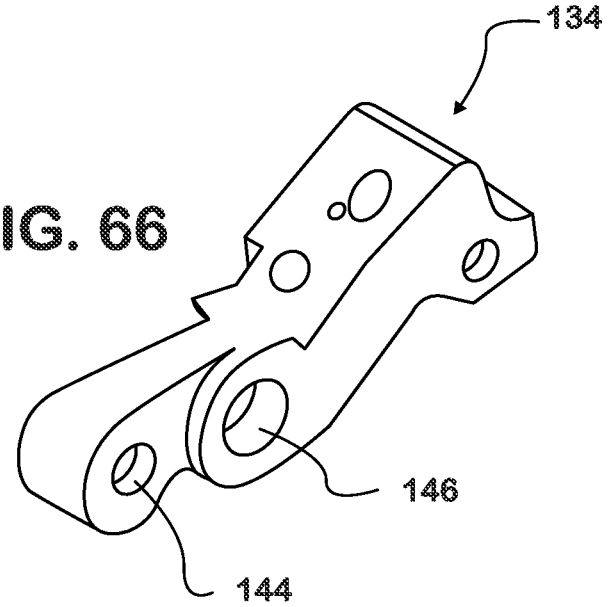
FIG. 66 illustrates a top perspective view of an embodiment of a clutch lever in accordance with the principles of the present disclosure.
Figure 67:
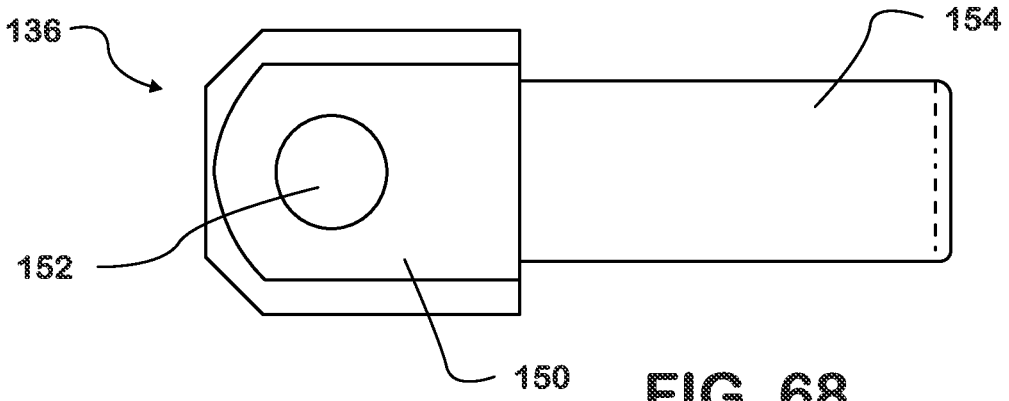
FIG. 67 illustrates a side plan view of an embodiment of a clutch pin in accordance with the principles of the present disclosure.
Figure 68:
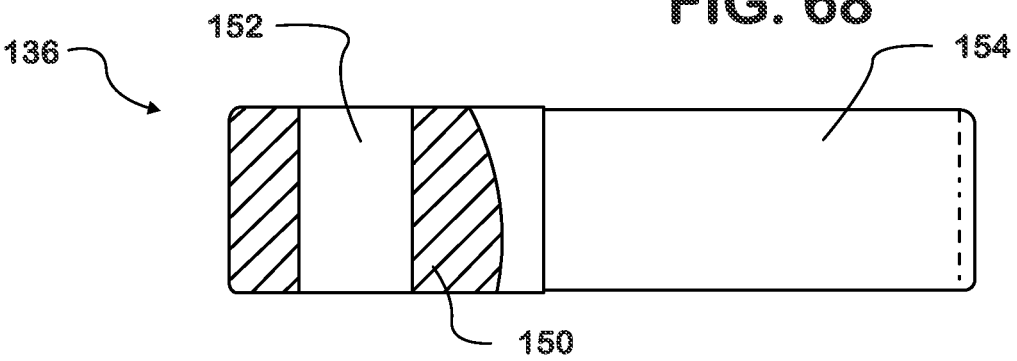
FIG. 68 illustrates a bottom cross sectional view of an embodiment of a clutch pin in accordance with the principles of the present disclosure.
Figure 69:
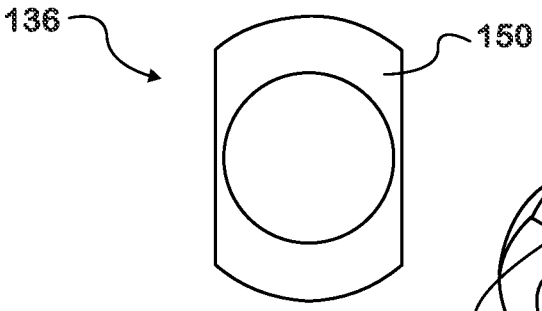
FIG. 69 illustrates a front plan view of an embodiment of a clutch pin in accordance with the principles of the present disclosure.
Figure 70:
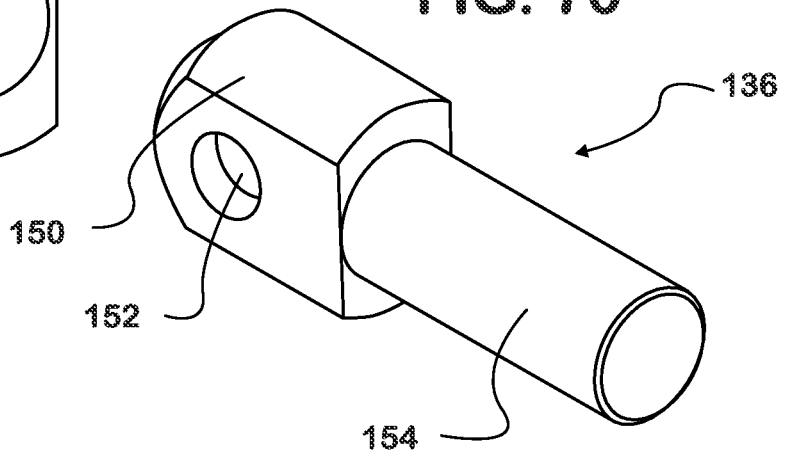
FIG. 70 illustrates a top perspective view of an embodiment of a clutch pin in accordance with the principles of the present disclosure.

Turning to FIG. 53, an exploded view of at least one embodiment of the clutch system 129 is illustrated. The clutch system 129 comprises a clutch mount cover 130, clutch cover 132, clutch lever 134, clutch pin 136, clutch pin link 138, clutch pressboard 140, a clutch cable mount 142, a pivot connection 146, and a peg 148. The clutch system 129 will comprise components to include a cable inside the clutch system 129 with connections at each end. The cable should slide easily inside the clutch system 129.

The clutch lever 134 that operates the clutch on a pivot connection 146. The pivot connection 146 comprises an opening and a peg 148 placed through the opening to allow the clutch lever to rotate freely about the peg and actuate a clutch pin (see FIGS. 67-70) that engaged the rotor clutch assembly 92. The clutch lever 134 can act as a fulcrum mounting flange and allow the clutch pin 136 to be actuated as desired.

Turning to FIGS. 54-58, at least one exemplary embodiment of the clutch mount cover 130 is illustrated in different views. The cable mount cover comprises a plurality of holes 110 for accepting fasteners, and can be affixed to the clutch cable mount 142.

Turning to FIGS. 59-62, at least one exemplary embodiment of a clutch cover 132 is illustrated in different views. The clutch cover 132 comprises a plurality of holes 110 for accepting fasteners and can be affixed to the clutch system 129 to cover the clutch system 129 and protect it from damage.

Turning to FIGS. 63-66, at least one exemplary embodiment of a clutch lever 134 is illustrated in multiple. Clutch lever 134 comprises a clutch pin link mounting hole 144 for affixing the clutch pin (see FIGS. 67-70) to the clutch cable mount 142.

Turning to FIGS. 67-70, at least one exemplary embodiment of a clutch pin 136 is illustrated in multiple views. The clutch pin 136 comprises a head 150, a fastener hole 152, and a rod 154. The fastener hole 152 is located in the head 150 and allows for the clutch pin 136 to be engaged to the clutch pin link 138 (see FIGS. 71-73). The clutch pin 136 will be fastened to the clutch pin link 138 using a means that will allow the clutch pin 136 to rotate as the clutch lever 134 is actuated and allowing the rod 154 to always point in the direction of the coupling 97 of the rotor clutch assembly 92. The rod 154 will enter the coupling 97 of the rotor clutch assembly 92 and cause the rotor clutch assembly 92 to engage or disengage the eccentric hub 28, e.g., start and stop vibration.

Figure 71:
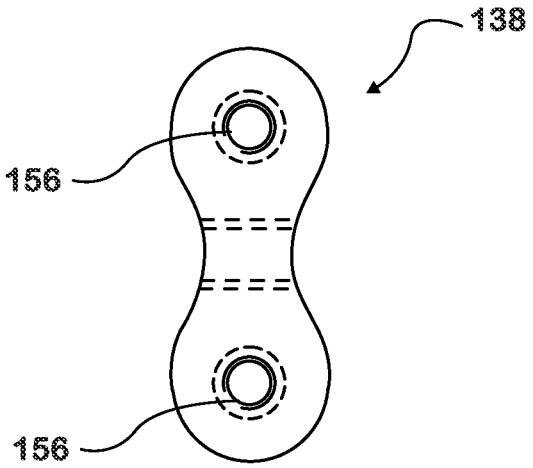
FIG. 71 illustrates a side plan view of an embodiment of a clutch pin link in accordance with the principles of the present disclosure.
Figure 72:
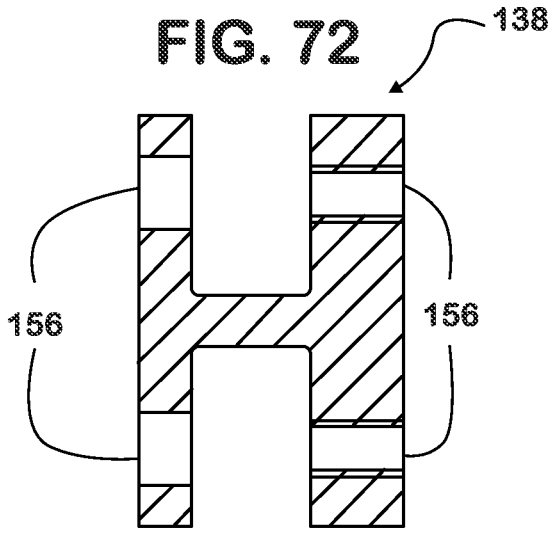
FIG. 72 illustrates a front cross section view of an embodiment of a clutch pin link in accordance with the principles of the present disclosure.
Figure 73:
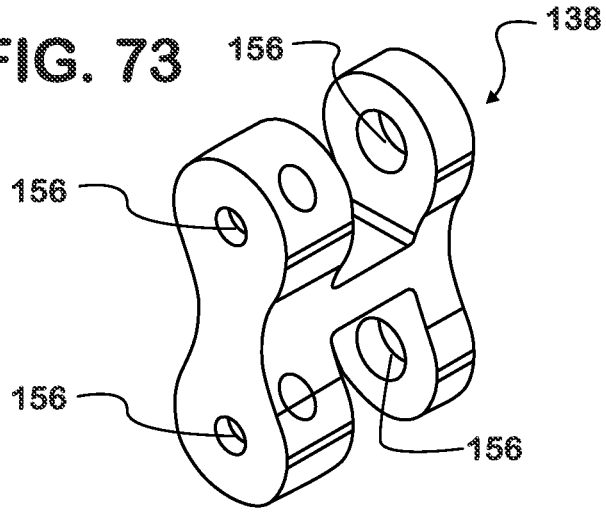
FIG. 73 illustrates a top perspective view of an embodiment of a clutch pin link in accordance with the principles of the present disclosure.

Turning to FIGS. 71-73, at least one exemplary embodiment of a clutch pin link 138 is illustrated in multiple views. The clutch pin link 138 connects the clutch pin 136 to the clutch lever 134. The clutch pin link 138 can be "H" shaped and comprise at least four fastener acceptors 156. Two of the fastener acceptors 156 can be used to affix the clutch pin link 138 to the clutch pin link mounting hole 144 on the clutch lever 134. Two of the fastener acceptors 156 can be used to affix the clutch pin 136 to the clutch pin link 138 by aligning the fastener hole 152 with the at least two fastener acceptors 156 and inserting a fastener through the aligned holes and acceptors.

Figure 74:
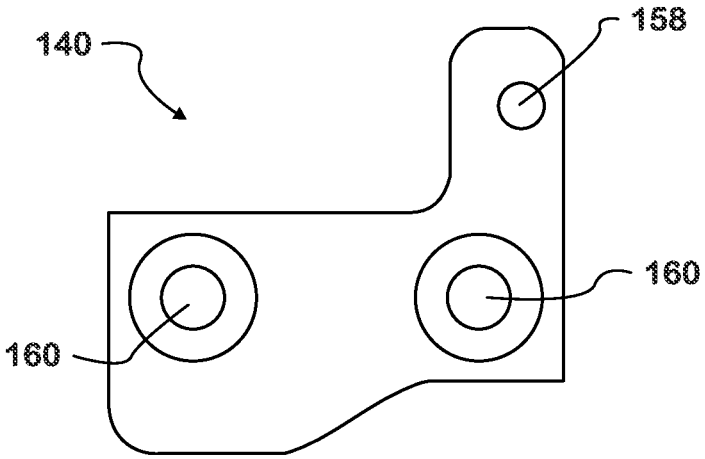
FIG. 74 is a side plan view of an embodiment of a clutch pressboard in accordance with the principles of the present disclosure.
Figure 75:
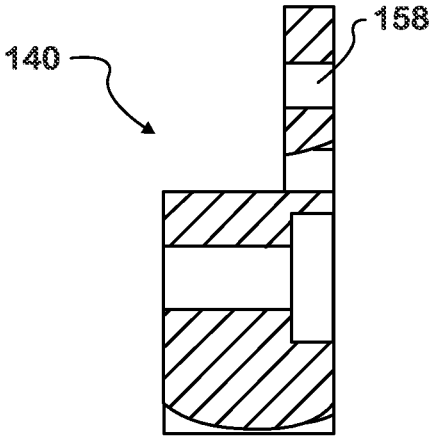
FIG. 75 is a rear cross section view of an embodiment of a clutch pressboard in accordance with the principles of the present disclosure.
Figure 76:
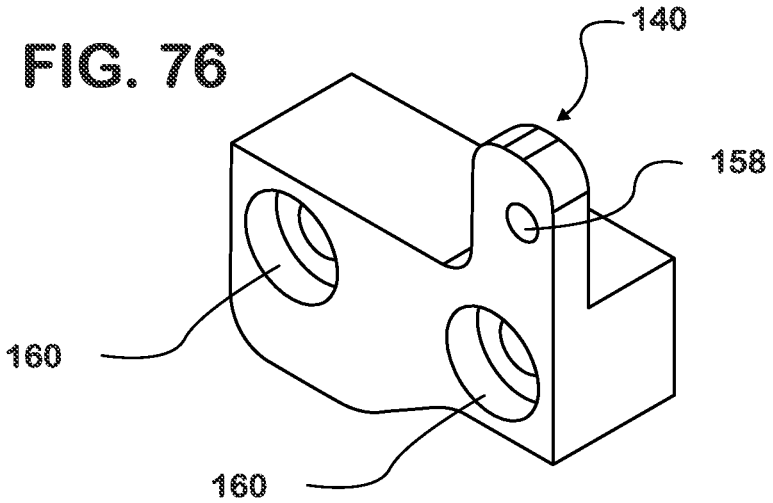
FIG. 76 is a top perspective view of an embodiment of a clutch pressboard in accordance with the principles of the present disclosure.
Figure 77:
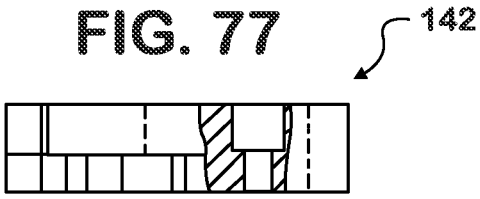
FIG. 77 is a top plan view of an embodiment of a clutch cable mount in accordance with the principles of the present disclosure.
Figure 78:
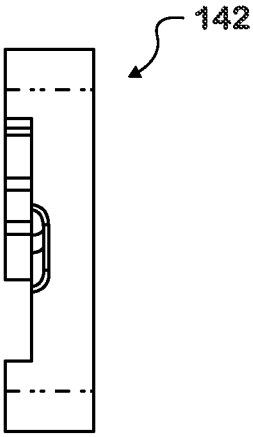
FIG. 78 is a front plan view of an embodiment of a clutch cable mount in accordance with the principles of the present disclosure.
Figure 79:
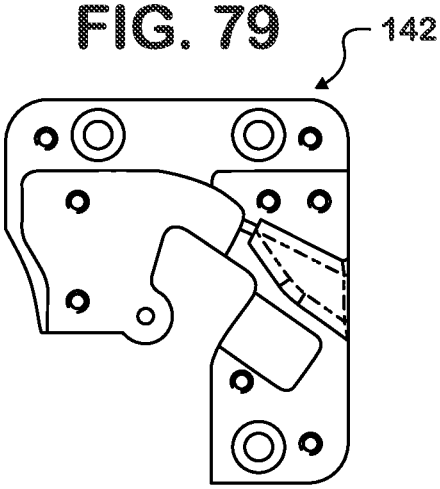
FIG. 79 is a side plan view of an embodiment of a clutch cable mount in accordance with the principles of the present disclosure.
Figure 80:
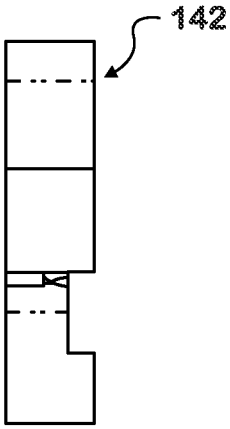
FIG. 80 is a rear plan view of an embodiment of a clutch cable mount in accordance with the principles of the present disclosure.

Turning to FIGS. 74-76, at least one exemplary embodiment of a clutch pressboard 140 is illustrated in multiple views. The clutch pressboard 140 comprises a rod opening 158 for accepting an end of the rod 154, and at least two fastener acceptors 160 for affixing the clutch pressboard 140 to the clutch cable mount 142. The clutch pressboard 140 can be used to secure the clutch lever 134 to the clutch cable mount 142 while allowing the clutch lever 134 to pivot freely.

Turning to FIGS. 77-81, at least one exemplary embodiment of a clutch cable mount 142 is illustrated in multiple views. The clutch cable mount 142 performs the function as acting as the hub for assembling the clutch system 129. The clutch cable mount 142 is adapted to accept each piece of the clutch assembly, e.g., clutch lever 134, clutch pressboard 140, clutch mount cover 130, and optionally the clutch cover 132. The clutch cable mount allows the clutch lever 134 to rotate and pivot when the clutch lever 134 is fastened to the clutch cable mount 142.

Turning to FIGS. 82-86, an embodiment of the belt tensioner assembly 127 is shown in different views. The belt tensioner assembly 127 comprises an upper roller 162, a lower roller 164, an upper spring 166, a lower spring 168, a tensioner mount 170, a upper roller bracket 172, and a lower roller bracket 174. The lower roller 164 can be rotatably engaged to an end of the lower roller bracket 174 and can put an upward pressure or tension on a lower portion of a looped belt. The upper roller 162 can be rotatably engaged to an end of the upper roller bracket 172 and can put a downward pressure on tension on an upper portion of a looped belt. The belt tensioner assembly 127 can provide tension to a belt to keep the belt from slipping during operation of an exercise machine comprising the hypotrochoid apparatus 10.

The upper spring 166 and lower spring 168 each comprise two ends, and one of the two ends can be engaged with the tensioner mount 170 and the tensioner mount 170 can be affixed to the frame of an exercise machine or to a fixed portion of the exercise machine to create tension on the upper spring 166 and lower spring 168. The other end of the upper spring 166 can be affixed to the upper bracket roller bracket 172. The other end of the lower spring 168 can be affixed to the lower roller bracket 174.

As to further manners of usage and operation of the present disclosure, the same should be apparent from the above description.

While an embodiment of the apparatus and method of use has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specification are intended to be encompassed by the present disclosure.

Those skilled in the art will appreciate that the invention described herein is susceptible to variations and modifications other than those specifically described, and that each embodiment is also provided with features that may be applicable to other embodiments. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A hypotrochoid apparatus for creating vibrations in an exercise machine, comprising:

an inner assembly and an outer assembly;

the inner assembly comprising a spindle, an eccentric hub, bearings, a key, a retaining ring, and an external involute gear, said spindle being located inside the inner assembly and having a spindle proximate end and a spindle distal end, wherein said spindle proximate end and said spindle distal end each comprises at least one mechanical interface;

a groove that runs around an outer circumference of the spindle for engaging an inner retainer ring, and the key positioned parallel to a longitudinal length of the spindle;

a first sealed bearing of the bearings mounted on the spindle proximate end;

a second sealed bearing of the bearings mounted on the spindle distal end, and the first sealed bearing and the second sealed bearing rotatably support the spindle;

the eccentric hub comprising a central throughbore for receiving the spindle, wherein the spindle is rotatably engaged with the eccentric hub and an inner bore enhances vibration when the spindle is rotating and the eccentric hub is engaged;

a first angular contact ball bearing of the bearings comprising a distal side and a proximate side and centrally mounted around the outer surface of the eccentric hub; and a second angular contact ball bearing of the bearings comprising a distal side and a proximate side being centrally mounted around the outer surface of the eccentric hub, wherein the proximate side of the first angular contact ball bearing abuts the distal side of the second angular contact ball bearing.

2. The hypotrochoid apparatus of claim 1, further comprising a first lock washer being engaged the distal side of the first angular contact ball bearing and a second lock washer engaged with the proximate side of the second angular contact ball bearing.

3. The hypotrochoid apparatus of claim 1, further comprising a first lock nut being engaged with a first lock washer and a second lock nut being engaged with a second lock washer.

4. The hypotrochoid apparatus of claim 1, wherein the external involute gear comprises a single planet gear comprising a key way for engaging the key and teeth surrounding an outer circumference the single planet gear.

5. The hypotrochoid apparatus of claim 1, wherein the outer assembly comprises an outer hollow housing being cylindrically shaped and having a proximate end and a distal end, a first retaining ring being positioned inside the outer hollow housing at the proximate end of the outer hollow housing.

6. The hypotrochoid apparatus of claim 5, wherein the outer assembly comprises a rotor clutch assembly positioned at the distal end of the outer hollow housing.

7. The hypotrochoid apparatus of claim 4, wherein the external involute gear comprises a single ring gear comprising teeth surrounding an inner circumference of the single ring gear for meshing with the teeth surrounding the outer circumference of the single planet gear of the inner assembly.

8. The hypotrochoid apparatus of claim 6, further comprising a ring shaped shim comprising a central opening, an inner surface, and an outer surface for closing a gap between the first retaining ring and the proximate end of the outer hollow housing after the inner assembly is concentrically coupled within the outer hollow housing, wherein the inner surface of the shim is abutted against the first retaining ring.

9. The hypotrochoid apparatus of claim 8, further comprising a second retaining ring positioned inside the proximate end of the outer hollow housing and abutted against the outer surface of the shim.

10. The hypotrochoid apparatus of claim 1, wherein the inner assembly is concentrically coupled within the outer assembly, and the at least one mechanical interface is coupled to a crank arm.

11. The hypotrochoid apparatus of claim 6, further comprising a clutch system to control the rotor clutch assembly and engage or disengage vibration.

12. A hypotrochoid apparatus for creating vibrations in an exercise machine, comprising:

an inner assembly and an outer assembly, wherein the outer assembly comprises an outer hollow housing having a proximate end and a distal end;

the inner assembly comprising a spindle, an eccentric hub, bearings, a key, a retaining ring, and an external involute gear, said spindle being located inside the inner assembly and having a spindle proximate end and a spindle distal end, wherein said spindle proximate end and said spindle distal end each comprises at least one mechanical interface;

a groove that runs around an outer circumference of the spindle for engaging an inner retainer ring, and the key positioned parallel to a longitudinal length of the spindle;

a first sealed bearing of the bearings mounted on the spindle proximate end;

a second sealed bearing of the bearings mounted on the spindle distal end, and the first sealed bearing and the second sealed bearing rotatably support the spindle;

the eccentric hub comprising a central throughbore for receiving the spindle, wherein the spindle is rotatably engaged with the eccentric hub and an inner bore enhances vibration when the spindle is rotating and the eccentric hub is engaged;

a first angular contact ball bearing of the bearings comprising a distal side and a proximate side and centrally mounted around the outer surface of the eccentric hub;

a second angular contact ball bearing of the bearings comprising a distal side and a proximate side being centrally mounted around the outer surface of the eccentric hub, wherein the proximate side of the first angular contact ball bearing abuts the distal side of the second angular contact ball bearing;

a belt tensioner system;

a rotor clutch assembly positioned at the distal end of the outer hollow housing; and a clutch system to control the rotor clutch assembly and engage or disengage vibration comprising a clutch, clutch lever, clutch pin, clutch pin link, clutch pressboard, and clutch cable mount.

13. The hypotrochoid apparatus of claim 12, wherein the clutch system further comprises a clutch mount cover.

14. The hypotrochoid apparatus of claim 12, wherein the clutch system further comprises a clutch cover.

15. The hypotrochoid apparatus of claim 12, wherein the clutch is an axis clutch.

16. A method for making hypotrochoid apparatus for creating vibrations in an exercise machine, the steps comprising:

assembling an inner assembly comprising a spindle, an eccentric hub, bearings, a key, a retaining ring, and an external involute gear, said spindle being located inside the inner assembly and having a spindle proximate end and a spindle distal end, wherein said spindle proximate end and said spindle distal end each comprises at least one mechanical interface;

creating a groove that runs around an outer circumference of the spindle for engaging an inner retainer ring;

positioning the key on top of, and parallel to a longitudinal length of, the spindle;

mounting a first sealed bearing of the bearings on the spindle proximate end;

mounting a second sealed bearing of the bearings on the spindle distal end, and the first sealed bearing and the second sealed bearing rotatably support the spindle;

forming the eccentric hub comprising a central throughbore for receiving the spindle, wherein the spindle is rotatably engaged with the eccentric hub and an inner bore enhances vibration when the spindle is rotating and the eccentric hub is engaged;

mounting a first angular contact ball bearing of the bearings comprising a distal side and a proximate side centrally around the outer surface of the eccentric hub; and mounting a second angular contact ball bearing of the bearings comprising a distal side and a proximate side centrally around the outer surface of the eccentric hub.

17. The method of claim 16 further comprising:

assembling an outer assembly comprising an outer housing having a proximate end and a distal end, wherein the inner assembly is positioned within the outer assembly;

assembling a rotor clutch assembly; and housing the rotor clutch assembly at the distal end of the outer housing.

18. The method of claim 17 further comprising:

controlling the rotor clutch assembly with a clutch system, wherein the rotor clutch assembly engages or disengages the eccentric hub vibration and the clutch system comprises a clutch, clutch lever, clutch pin, clutch pin link, clutch pressboard, and clutch cable mount.

19. The method of claim 17 further comprising:

assembling a clutch system comprising a clutch, clutch lever, clutch pin, clutch pin link, clutch pressboard, and clutch cable mount.

20. The method of claim 17 further comprising:

engaging the clutch system to the rotor clutch assembly by inserting the clutch pin into a coupling located on the outer surface of the rotor clutch assembly.

* * * * *